US009316969B2

(12) United States Patent
Sato

(10) Patent No.: US 9,316,969 B2
(45) Date of Patent: Apr. 19, 2016

(54) FUSER CONTROL DEVICE AND IMAGE FORMING APPARATUS

(71) Applicant: Oki Data Corporation, Tokyo (JP)

(72) Inventor: Toshiki Sato, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 14/304,431

(22) Filed: Jun. 13, 2014

(65) Prior Publication Data

US 2014/0369708 A1 Dec. 18, 2014

(30) Foreign Application Priority Data

Jun. 14, 2013 (JP) ..... 2013-125693

(51) Int. Cl.
*G03G 15/20* (2006.01)

(52) U.S. Cl.
CPC .... *G03G 15/2042* (2013.01); *G03G 2215/2022* (2013.01)

(58) Field of Classification Search
CPC ..... G03G 15/2039
USPC ..... 399/67–70; 219/216
See application file for complete search history.

(56) References Cited

U.S. PATENT DOCUMENTS 5,621,512 A * 4/1997 Uehara et al.
6,321,046 B1 * 11/2001 Kikuchi et al. ..... 399/69
7,013,097 B2 * 3/2006 Akizuki et al. ..... 399/69
8,010,028 B2 * 8/2011 Shinshi
8,295,727 B2 * 10/2012 Sato ..... G03G 15/2039 399/69

FOREIGN PATENT DOCUMENTS

JP 2001282033 A * 10/2001
JP 2005173100 A * 6/2005
JP 2008-249763 A 10/2008

* cited by examiner

*Primary Examiner* — Walter L Lindsay, Jr.
*Assistant Examiner* — Milton Gonzalez
(74) *Attorney, Agent, or Firm* — Muncy, Geissler, Olds & Lowe, P.C.

(57) ABSTRACT

A fuser control device includes a heat application part for heat supply, a fuser part that has a passage region where a print medium passes through and a not-passage region that is located at both sides of the passage region where the print medium does not pass through, and a first temperature detection part that detects a first temperature of the passage region, a second temperature detection part that detects a second temperature of the not-passage region, and a heat application controller that changes a target temperature according to the first detection temperature and the second detection temperature, and performs the heat generation such that a temperature of the fuser part approaches the target temperature.

20 Claims, 18 Drawing Sheets

FUSER CONTROL DEVICE AND IMAGE FORMING APPARATUS

TECHNICAL FIELD

The present invention relates to a fuser control device and an image forming apparatus provided with the fuser control device.

BACKGROUND

In an electrophotographic printer, toner that corresponds to a print image is transferred to a sheet, and a transferred toner image is fused to the sheet with heat and pressure. Conventionally, in a fuser control device and an image forming apparatus that are disclosed in the patent document 1 below, a plurality of heaters and a plurality of temperature detection parts are provided in a longitudinal direction in different positions in a fuser in the fuser control device, and the plurality of heaters are controlled separately based on the plurality of temperature detection parts, so that stabilization of temperature of the fuser in the longitudinal direction is acquired.

RELATED TECHNICAL DOCUMENT(S)

Patent Document(s)

Patent Document 1: JP Laid-Open Patent Application 2008-249763

SUMMARY OF INVENTION

Subject(s) to be Resolved

However, conventional fuser control device and image forming apparatus have drawbacks following (a) or (b).

(a) When a print operation starts where the apparatus becomes cooled to the room temperature, because a temperature of holding member 21 that holds a fuser is low and a heat capacity of the holding member is large, a heat application deficiency occurs at a end part of the fuser that is adjacent to the holding member, causing fusion deficiency.

(b) For the measure regarding the above (a), there is a control way to set initial temperature of a fuser higher in advance. However, such a fuser control device and image forming apparatus consumes large amount of electric power.

Means to Resolve the Subject(s)

A fuser control device of the first invention includes a heat application part that generates heat and supplies the heat; a fuser part that has a passage region where a print medium passes through and a not-passage region that is located at both sides of the passage region where the print medium does not pass through, and that fuses an image on the print medium by the heat applied from the heat application part while the print medium passes therethrough; a first temperature detection part that detects a temperature of the passage region and outputs a first detection temperature determined by the detected temperature; a second temperature detection part that detects another temperature of the not-passage region and outputs a second detection temperature determined by the detected another temperature; and a heat application controller that changes a target temperature of the fuser part according to the first detection temperature and the second detection temperature, and controls the heat application part so that a temperature of the fuser part approaches the target temperature.

Another fuser control device of the second invention further includes a holding member that holds the fuser part, and a third temperature detection part that detects a temperature of the holding member and outputs a third detection temperature determined by the detected temperature of the holding member. The heat application controller part changes the target temperature according to the first detection temperature and the second detection temperature and corrects the target temperature with the third detection temperature.

An image forming apparatus of the third invention is equipped with the fuser control device of the above first or second invention.

According to the fuser control device or the image forming apparatus of the present invention, following elements are provided: a first temperature detection part that detects a temperature of the passage region and outputs a first detection temperature determined by the detected temperature; a second temperature detection part that detects another temperature of the not-passage region and outputs a second detection temperature determined by the detected another temperature; and a heat application controller that changes a target temperature of the fuser part according to the first detection temperature and the second detection temperature, and controls the heat application part so that a temperature of the fuser part approaches the target temperature. Therewith, while preventing from an occurrence of the fusion deficiency due to lack of heat application of the fuser means, a fusion control device and image forming device that realize a low power consumption are provided.

DETAILED DESCRIPTION OF EMBODIMENT

Embodiments to work the present invention could be obvious when explanation of preferred embodiments that are described later were read as referring to the attached drawings. However, the drawings were prepared for the purpose of explanation and don't intend to limit the scope of the present invention.

First Embodiment

Configuration of First Embodiment

Figure 2:
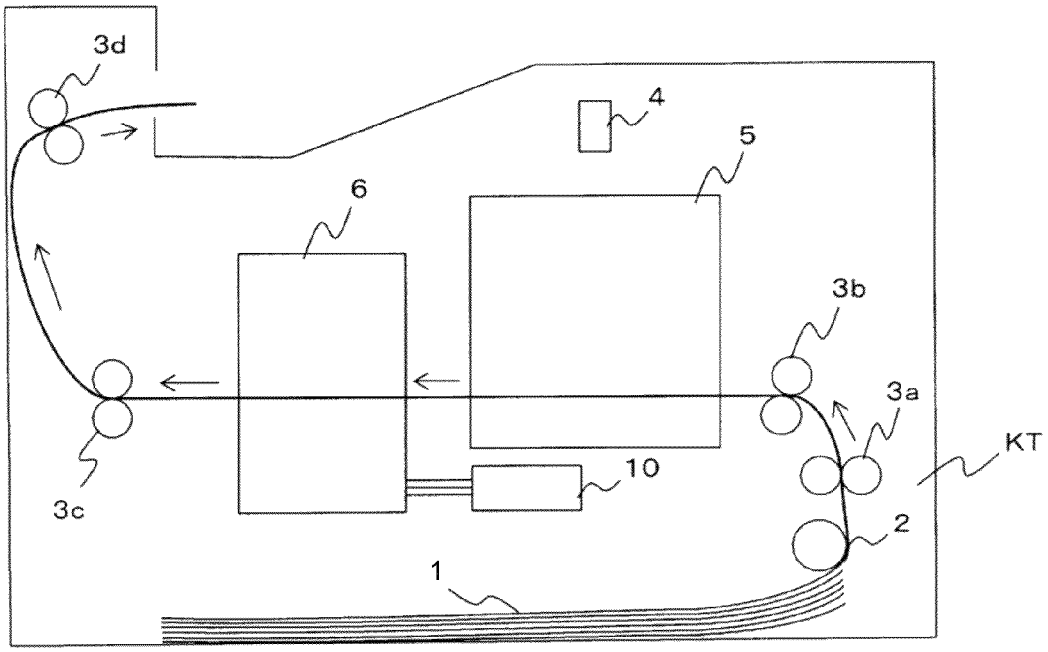
FIG. 2 shows a schematic configuration of an image forming apparatus according to a first embodiment.

FIG. 2 shows a schematic configuration of an image forming apparatus according to a first embodiment of the present invention.

The image forming apparatus of the first embodiment is for example a printer and has a house KT. In the house KT, a hopping roller 2 that feeds a sheet 1 as a print medium, sheet carrying parts 3*a*-3*c* that carry the sheet 1 fed by the hopping roller 2 in an arrow direction, a light-emitting diode (hereinafter, to be referred to as LED) head 4 as an exposure member of recording light, a toner image forming part 5 that forms a toner image as a developer image corresponding to recording light, and a fuser 6 as a fuser part that fuses the toner image on the sheet 1 are provided. In an order of carrying the sheet 1, the toner image forming part 5 and the fuser 6 are arranged. The LED head 4 is arranged in adjacent to the toner image forming part 5.

Figure 1:
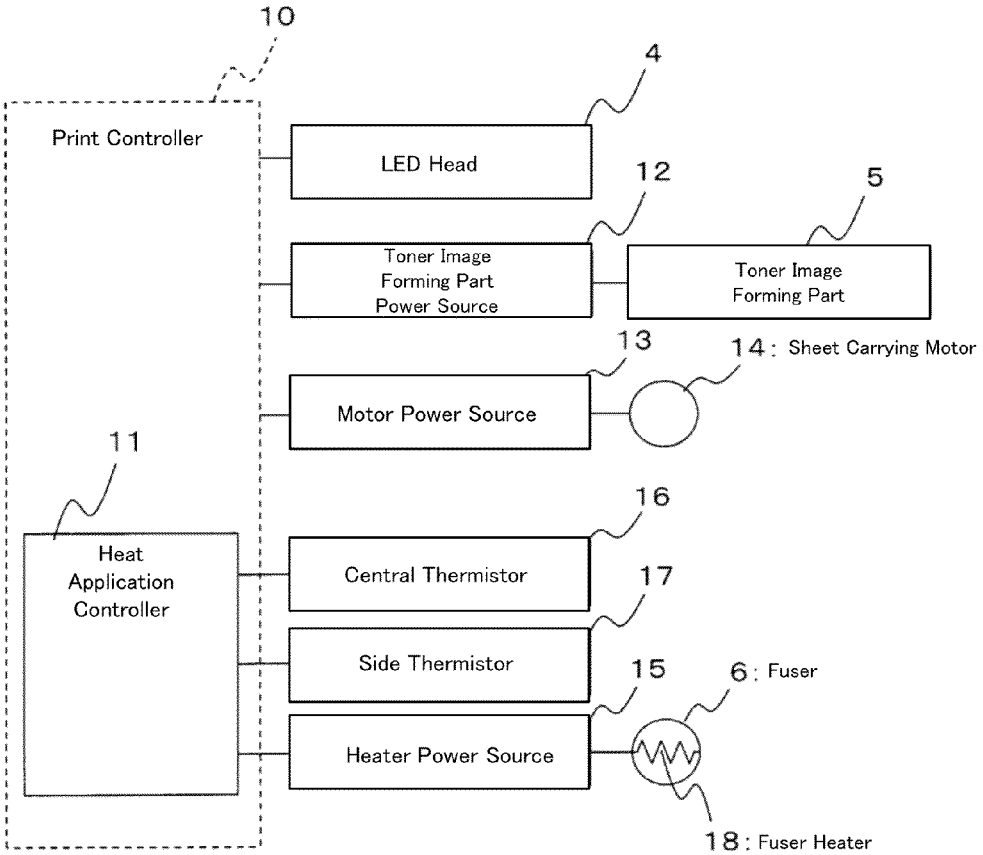
FIG. 1 is a block diagram that shows a schematic configuration of an image forming apparatus of FIG. 2.

FIG. 1 is a block diagram that shows a schematic configuration of the image forming apparatus of FIG. 2. The image forming apparatus of the first embodiment includes a print controller 10 that controls entire print motion. The print controller 10 incorporates a heat application controller 11 that performs heat application control of temperature of the fuser 6.

The printer controller 10 is connected to the LED head 4, a toner image forming part power source 12 that applies development voltage to the toner image forming part 5, and a motor power source 13 that supplies power to a sheet carrying motor 14 that carries the sheet 1.

The heat application controller 11 performs on/off control on a heater power source 15 that supplies power to a fuser heater 18 as a heat application part incorporated by the fuser 6 based on a detection result of temperature of the fuser 6. The heat application controller 11 is connected to the heater power source 15, a central thermistor 16, and a side thermistor 17. The central thermistor 16 works as a first temperature detection part that detects temperature of a passage region where the sheet 1 passes through in the fuser 6 and outputs a first detection temperature. The side thermistor 17 works as a second temperature detection part that detects temperature of a not-passage region that is both sides of the passage region where the sheet 1 doesn't pass through in the fuser 6 and outputs a second detection temperature.

In the present invention, the "passage region" means a region through which a sheet having a printable maximum width. In general, the passage region is disposed at a central part of the heat application roller in the longitudinal direction. However, in one embodiment, the region may be offset to right or left side. Similarly, the not-passage region as well does not have to be evenly disposed in the passage region in the right-left direction. The not-passage region may be offset to one of the sides or may be disposed only in one of the right and left sides. The printer is able to select several sized media and print thereon. The printable maximum width size of the medium is, for example, 328 mm width (the medium size 328 mm×453 mm that is one size larger than A3). The printable minimal width size of the medium is, for example, 64 mm (64 mm=182 mm that is B6 half size). These sized medium can be selected. The fuser is designed to be able to fuse a region having a width (328 mm) in the medium carrying direction, which corresponds to the printable maximum width size. The passage region of a medium having the printable minimal width size (width 64 mm) can be set anywhere within the region of the printable maximum width (328 mm). The center lines of the maximum width and the minimal width may be coincident. However, the minimal width can be offset to right or left side of the maximum width.

The measurement position of the central part temperature sensor in the embodiment is required to be disposed within a range of the medium having the printable maximal width size. Further, more specifying, the range for the sensor is to be within another range where, even when the medium that is carried is offset from the center line, a developer can be disposed on the medium. The range is also considered as a range where the medium passes at every time even when the medium carrying offset (a gap from the center line) occurs. The medium carrying offset means an expected amount of offset that regularly occurs during the normal operation. For an example, the sensor is placed at 2 mm inside from an end part of each medium. Further specifying, the sensor is placed within a print assurance range of the minimal width side. The print assurance range means a range in which a certain quality of prints is assured by its manufacture. For an example, 6.35 mm is provided from each end part by a manufacture. As discussed above, the measurement position of the central part temperature sensor in the longitudinal direction of the fuser is within the printable range of the maximum width size, and is within the print assurance range of the minimal width size in the passage range of the printable minimal width size medium.

A fuser control device according to the first embodiment is configured with the heat application controller 11, the heater power source 15, the fuser heater 18, the fuser 6, the central thermistor 16, and the side thermistor 17. A heat application control part is configured with the heat application controller 11 and the heater power source 15 in the fuser control device.

Figure 3:
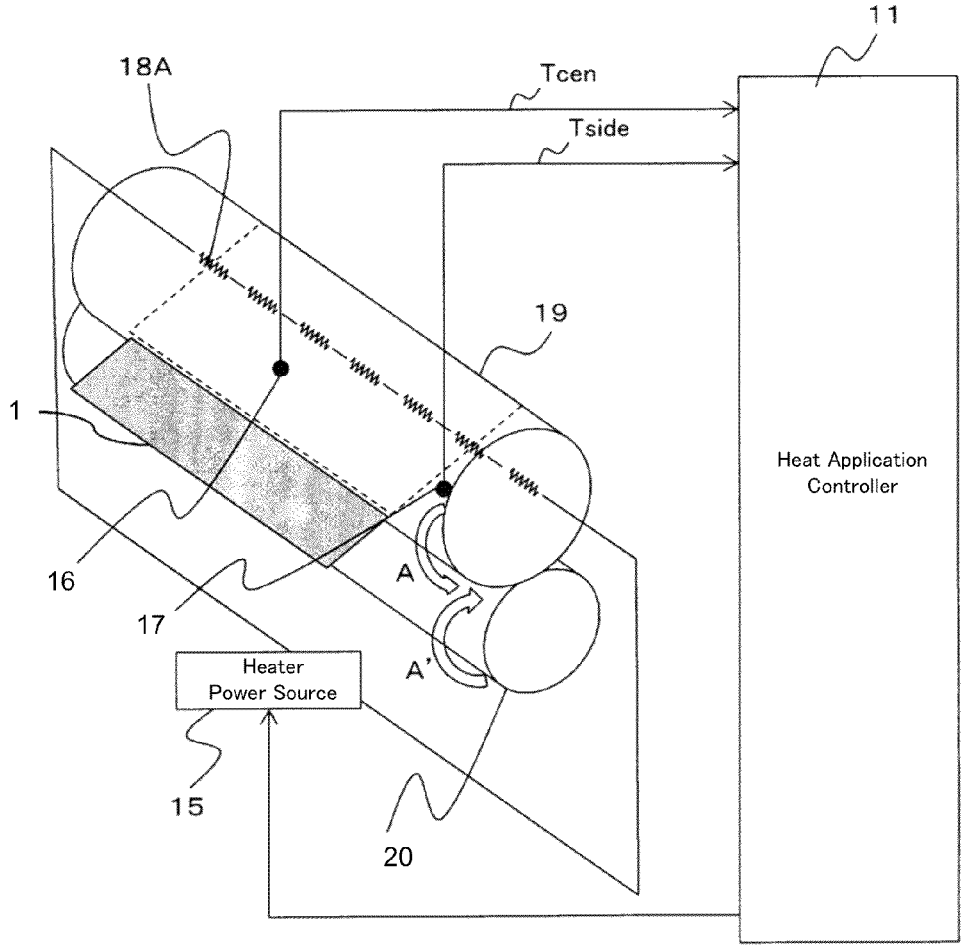
FIG. 3 is a perspective view that explains an overview of temperature control of a fuser 6 in FIG. 2.

FIG. 3 is a perspective view that explains an overview of temperature control of the fuser 6 in FIG. 2. The fuser 6 is configured with a heat application roller 19, the fuser heater 18, a pressure application roller 20, the central thermistor 16, and the side thermistor 17. The heat application roller 19 works as a heat application member that carries the sheet 1 as heating the sheet 1. The fuser heater 18 (for example, a halogen heater 18A) is arranged uncontiguously in the heat application roller 19 and heats the heat application roller 19. The pressure application roller 20 works as a pressure application member that is contiguous to the heat application roller 19 and applies pressure on the sheet 1 toward the heat application roller 19. The central thermistor 16 detects temperature of the passage region of the heat application roller 19 and outputs the first detection temperature. The side thermistor 17 detects temperature of the not-passage region of the heat application roller 19 and outputs the second detection temperature.

The heat application roller 19 is a cylinder shape with a diameter of 30 mm and has a core metal as a base configured of an element tube made of aluminum. The heat application roller 19 has a gear (not illustrated), and the heat application roller 19 is rotatably driven when the gear is rotatably driven by the sheet carrying parts 3*a*-3*d* illustrated in FIG. 2.

The pressure application roller 20 is pressed by an elastic body such as a spring (not illustrated) in a direction so that the pressure application roller 20 contacts and presses the heat application roller 19. The pressure application roller 20 contacts the heat application roller 19, and a nip part N is formed by the contact portion.

The thermistors 16 and 17 are elements that have a characteristic, of which a resistance decreases in accordance with a temperature increase. The heat application controller 11 detects resistances of the thermistors 16 and 17, and calculates the first detection temperature and the second detection temperature respectively from the resistances of the central thermistor 16 and the side thermistor 17. The central thermistor 16 is arranged uncontiguously in a longitudinal direction central part on a surface of the heat application roller 19. The side thermistor 17 is arranged contiguously in the not-passage region in the longitudinal direction on the surface of the heat application roller 19. The central thermistor 16 calculates a surface temperature of a part of the heat application roller 19 in the passage region where the sheet 1 always passes through. The side thermistor 17 is arranged in a longitudinal direction end part of the heat application roller 19, and calculates a surface temperature of a part of the heat application roller 19 in the not-passage region where the sheet 1 does not pass through in particular. The central thermistor 16 and the side thermistor 17 respectively output the first detection temperature Tcen and the second detection temperature Tside to the heat application controller 11.

Figure 4A:
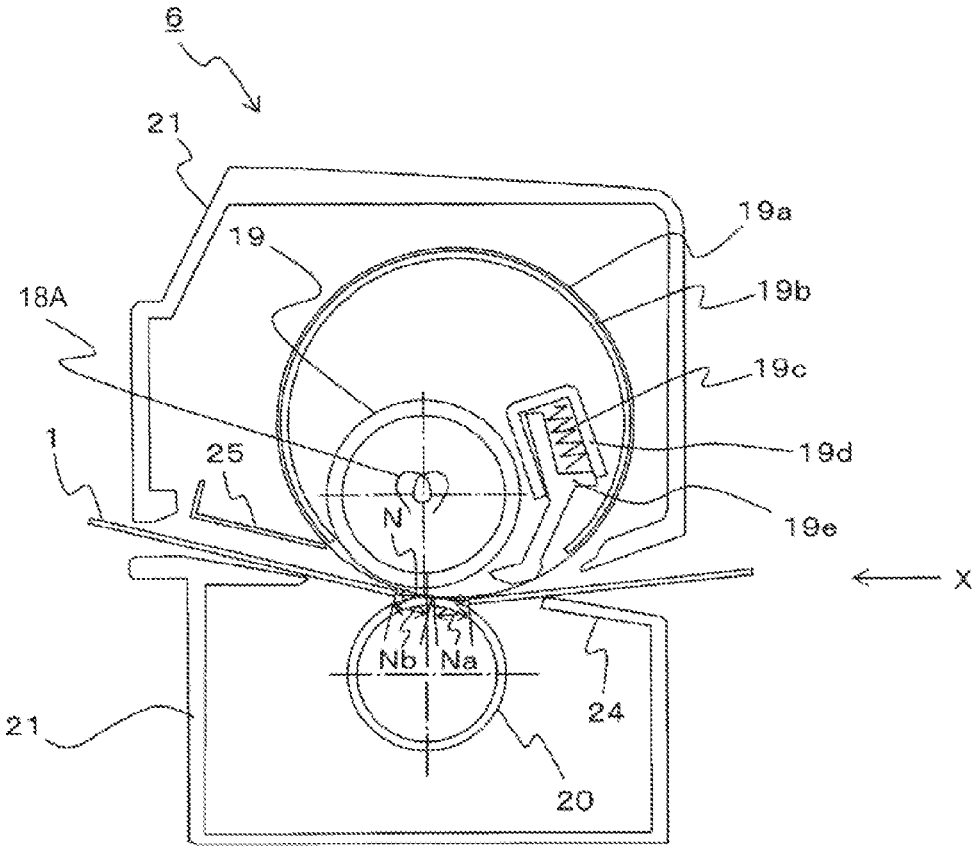
FIG. 4A is a sectional view that shows a structure of the belt system for the fuser 6 in FIG. 2.

The heat application controller 11 outputs a control signal to the heater power source 15 that supplies power to the halogen heater 18A. The heat application controller 11 calculates an end part temperature Tend of the sheet 1 on the heat application roller 19 from the first detection temperature Tcen and the second detection temperature Tside, and outputs the control signal to the heater power source 15 that supplies power to the halogen heater 18A such that the temperature Tcen of the central part of the heat application roller 19 becomes a predetermined target temperature. Accordingly, the heat application controller 11 performs on/off control on the heater power source 15. The calculations of the end part temperatures Tend are performed below:

i) add thermistors in vicinities of sheet end part, ii) exercise prints under various conditions iii) obtains the results of the calculations based on a temperature process of the prints FIG. 4A is a sectional view that shows a structure of the belt system fuser 6 in FIG. 2. The fuser 6 is held by a holding member 21. The fuser 6 has the heating roller 19, the pressure application roller 20 that holds the sheet 1 on which a toner image is formed with the heat application roller 19 and applies a pressure, and a fuser belt 19*a* that is an endless belt that rotates as contacting the heat application roller 19 suspended by a pressure application pad 19*e* as a second pressure application member.

The heat application roller 19 is connected to a driving motor (not illustrated) via a gear (not illustrated), and is rotatably driven by the driving motor. The heat application roller 19 is pressed by a spring 19*c* in a direction such that the heat application roller 19 is contacted and pressed to the pressure application roller 20. The pressure application roller 20 is contacted and pressed to the heat application roller 19, and the nip part N is formed by the contact portion.

The heat application roller 19 and the pressure application pad 19*e* are arranged inside the fuser belt 19*a*, and are configured to apply pressure to the pressure application roller 20 through the fuser belt 19*a*. Furthermore, the pressure application pad 19*e* is arranged in an upperstream side of the pressure application roller 20 in a traveling direction (sheet carrying direction X) of the fuser belt 19*a*. The pressure application pad 19*e* and the heat application roller 19 are biased to the pressure application roller 20 through the fuser belt 19*a* respectively by bias force of the spring 19*c* as a bias member and by bias force of a spring (not illustrated). The heat application roller 19 is configured of a core metal of a hollow pipe made of a metal such as iron or aluminum, for example.

The pressure application pad 19*e* is disposed movably along a pressure application pad guide 19*d* that is attached to the holding member 21. The pressure application pad 19*e* is configured to be biased to the pressure application roller 20 through the fuser belt 19*a* by the spring 19*c* of which one end is firmly attached to the pressure application pad guide 19*d*.

The fuser belt 19*a* is configured with an endless film that is configured from a base layer formed of polyimide for example, a heat-resistant elastic layer made of silicone formed on a surface of the base layer, and a release layer formed on the elastic layer. The fuser belt 19*a* is suspended by a fuser belt guide 19*b* as a guide member firmly attached to the holding member 21, the heat application roller 19, and the pressure application pad 19*e*. The fuser belt 19*a* is held by the heat application roller 19 and the pressure application roller 20 and forms a nip part Na. Also, the fuser belt 19*a* is held by the heat application roller 19 and the pressure application pad 19*e*, and forms a nip part. The nip part means a region in which a pressure and heat are applied to the sheet that passes through the region, a developer on the sheet is fused by the pressure and heat during passing the region. In the embodiment shown in FIG. 4A, the heat application roller 19 is disposed opposed to the pressure application roller 20. The heat application roller is disposed offset a little toward the upstream side in the sheet carrying direction with respect to a center of the pressure application roller 20. Therewith, divided by the center of the pressure application roller, there are nip part Na at a downstream side and nip part Nb at the upstream side. A pressure application pad 19*e* is provided at the downstream side of the heat application roller 19 and insider the fuser belt 19*a*. The pressure application pad 19*e* pushes the fuser belt 19*a* from inside to outside. As a result, the nip part extends toward the downstream side, forming the nip part Na.

As described above, because two nip parts Na and Nb are formed, as compared to a case where the nip part N is formed with one nip part, a larger quantity of heat can be given to the sheet 1 while the sheet 1 passes through. This results in effects that temperature of the fuser 6 is decreased and faster printing becomes possible.

Furthermore, bias force (pressure) of the pressure application roller 20 to the heat application roller 19 at the nip part Nb is set to be larger than bias force (pressure) of pressure application pad 19*e* to the heat application roller 19 at the nip part Na. As a result, pressure given to the toner as developer on the sheet 1 becomes higher at an exit area than at an entrance area, and this results in an effect that toner can be efficiently and effectively fused.

In other words, toner has a characteristic that toner melts more with a higher temperature. Toner on the sheet 1 passing through the nip part Na is not sufficiently heated, so in that situation, melting of the toner is insufficient. In the nip part Nb, toner is sufficiently heated. So when pressure application on the sheet 1 and toner is performed with relatively high pressure, it is possible to transform and fuse the toner effectively.

A sheet guide 24 is firmly attached to the holding member 21, and has a function that guides the sheet 1 carried from the toner image forming part 5. A separate plate 25 is a separate latch that separates the sheet 1 clinging to the heat application roller 19, and is arranged close to the heat application roller 19.

Note, the fuser belt 19*a* illustrated in FIG. 4A is disposed to contain the heat application roller 19 and contacts the pressure application roller 20. However, it is also possible to dispose the fuser belt 19*a* to contain the pressure application roller 20 and contact the heat application roller 19.

Figure 4B:
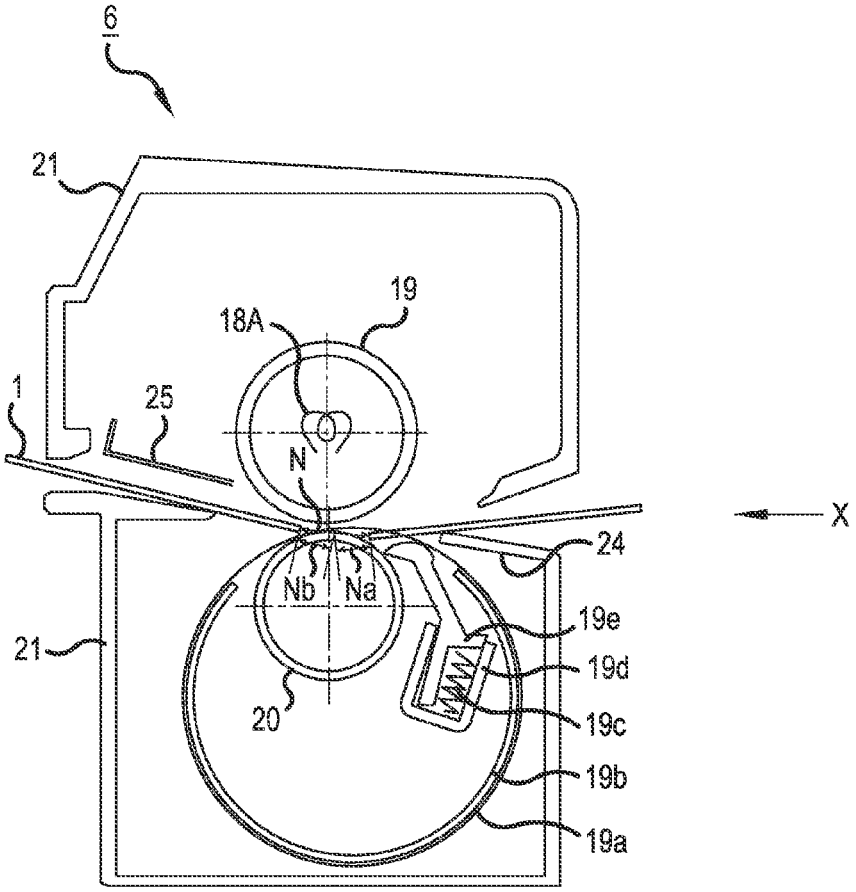
FIG. 4B is a sectional view that shows an alternative structure of the belt system for the fuser 6.

FIG. 4B is a sectional view that shows an alternative structure of the belt system for the fuser 6. In this alternative structure of the belt system, the fuser belt 19*a*, the fuser belt guide 19*b*, the spring 19*c*, the pressure application pad guide 19*d* and the pressure application pad 19*e* are provided on the side of the pressure application roller 20 such that the fuser belt 19*a* rotates around the pressure application roller 20.

Figure 5A:
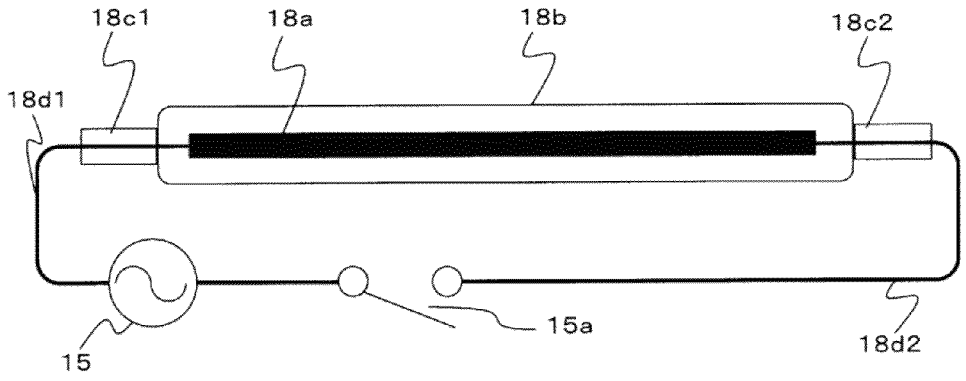
FIG. 5A explains a structure of a halogen heater 18A in FIG. 3 and FIG. 5B explains a heat generation method.
Figure 5B:
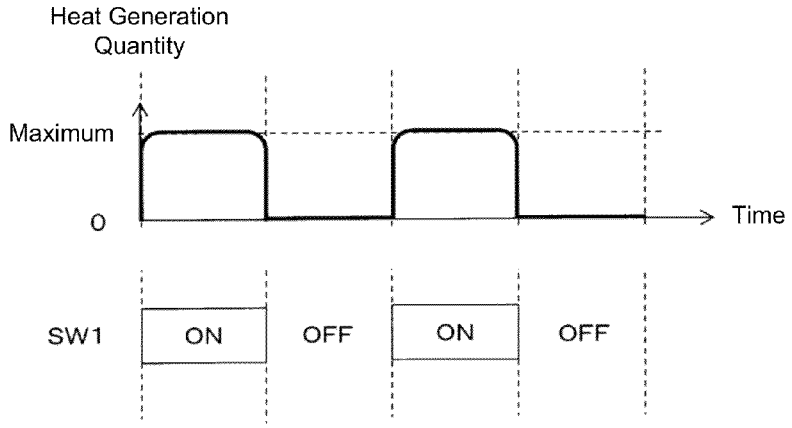

FIG. 5A explains a structure of the halogen heater 18A in FIG. 3 and FIG. 5B explains a heat generation method.

FIG. 5A shows a structure of the halogen heater 18A and FIG. 5B shows a relationship between heat generation quantities of the halogen heater 18A and on/off states of a switch 15*a*.

In FIG. 5A, the halogen heater 18A is configured with a filament 18*a*, a glass tube 18*b*, and insulators 18*c*1 and 18*c*2. The filament 18*a* is a heating body made of tungsten, for example. The glass tube 18*b* holds the filament 18*a*. The insulators 18*c*1 and 18*c*2 are disposed on both end parts of the glass tube 18*b* to electrically insulate the holding member 21, and made of ceramic, for example. In the glass tube 18*b*, inert gases such as argon and krypton, and bromine, chlorine and the like are enclosed in a state of an organic halide.

The halogen heater 18A exerts a heat application function thereof over a life time of the fuser 6 by heating/cooling inert gas, bromine, chlorine, and organohalide contained and sealed by a glass tube 18*b* by supplying and stopping power to the filament 18*a* to generate halogen cycle in halogen and tungsten. The AC heater power source 15 incorporates the switch 15*a* that performs on/off control on power supplied to the filament 18*a*. The halogen heater 18A is connected to the heater power source 15 via heater wires 18*d*1 and 18*d*2.

The switch 15*a* performs on/off control on a conduction state with a control signal output from the heat application controller 11. The switch 15*a* is configured with a semiconductor switch such as a triac that is able to flow large current. When the switch 15*a* is on, the filament 18*a* is heated by power supplied from the heater power source 15, and when the switch 15*a* is off, heating of the filament 18*a* stops upon stop of power supply from the heater power source 15.

Power supplied from the heater power source 15 is transmitted to the filament 18*a* via the wires 18*d*1 and 18*d*2, and the filament 18*a* is heated by the power. The glass tube 18*b* is translucent, so heat generated by the heat generation of the filament 18*a* penetrates the glass tube 18*b* and radiates to an internal surface of the core metal of the heat application roller 19. An output voltage of the heater power source 15 is for example 100V AC, and a power consumption of the filament 18*a* is for example 1200W.

FIG. 5B shows a relationship between heat generation quantities of the filament 18*a* and on/off states of a switch 15*a*. The heater power source 15 controls only two states that are a supplying state of AC current and a shut state of AC current with on/off of the switch 15*a*. From this reason, adjustment of heat application quantity of the heat application roller 19 is controlled by adjusting a period of time of heating in a predetermined length of time.

Figure 6A:
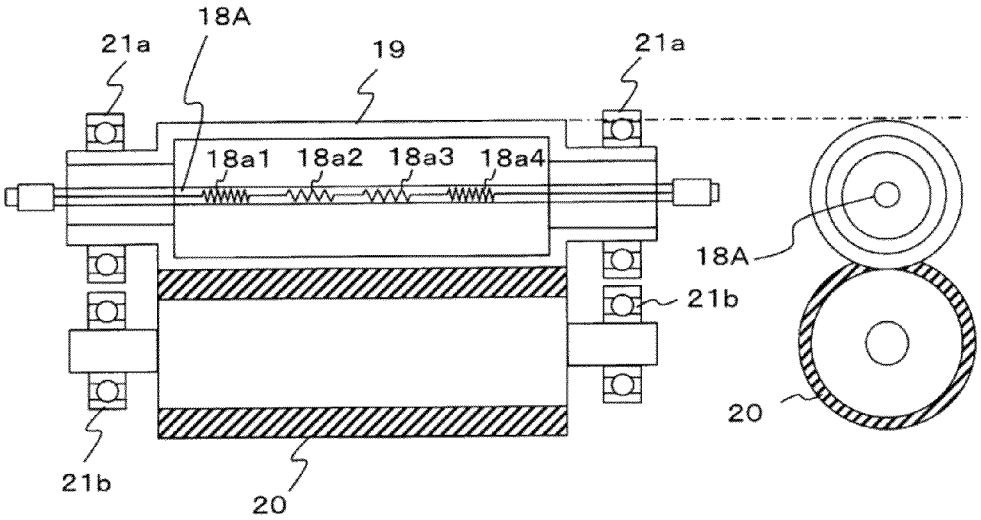
FIG. 6A explains the structure of the fuser 6 in FIG. 3 and FIG. 6B explains a distribution of heat generation quantity of the halogen heater 18A.
Figure 6B:
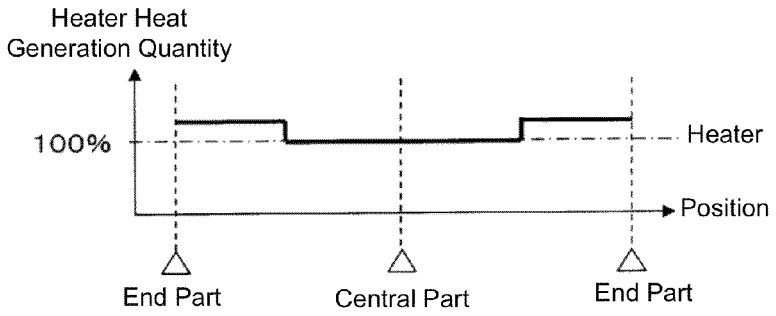

FIG. 6A explains a structure of the fuser 6 in FIG. 3 and FIG. 6B explains a distribution of heat generation quantity of the halogen heater 18A.

FIG. 6A shows a structure that one piece of the halogen heater 18A is incorporated by the heat application roller 19. FIG. 6B shows a distribution of heat generation quantity of the halogen heater 18A in a longitudinal direction.

The heat application roller 19 needs to carry the sheet 1 with the pressure application roller 20 as holding the sheet 1 with the pressure application roller 20, so respective both end parts of the heat application roller 19 and the pressure application roller 20 are rotatably held by ball bearings 21*a* and 21*b* that are held by the holding member 21. Therefore, heat radiating to the heat application roller 19 is partially is conducted by the ball bearings 21*a* and the holding member 21 to the housing KT in FIG. 2. The housing KT needs strength so it should be made solid. As a result, a heat capacity of the housing KT becomes tremendously larger than that of the heat application roller 19.

Accordingly, especially when heating of the heat application roller 19 is started in a state where the entire part of the fuser 6 is cooled to a room temperature, even if the temperature Tcen of the central part of the heat application roller 19 which is the passage region of the sheet 1 is increased, an end part temperature Tend of the sheet 1 in the longitudinal direction of the heat application roller 19 is not sufficiently increased because heat is released to the housing KT, and fusion deficiency may occur. In order to prevent the fusion deficiency at the time of print start, in a first example, heat generation quantity of the end parts was set to be larger by setting resistances of the filaments 18*a*1 and 18*a*4 that are arranged close to the end parts of the inside of the halogen heater 18A to be larger than resistances of the filaments 18*a*2 and 18*a*3 of the central part, for example.

Actions of First Example

In actions of a first example, an explanation consisting of: (I) Actions of Image Forming Apparatus; (II) Actions Of Fuser Control Device Of Comparative Examples; (III) Correlation Of Temperature Differences Of Fuser 6 In FIG. 3; And (IV) Actions Of Fuser Control Device Of First Example is given.

(I) Actions of Image Forming Apparatus

Referring to FIG. 1 and FIG. 2, schematic actions of the image forming apparatus are explained.

In FIG. 1, upon a receipt of a print instruction, the print controller 10 drives the LED head 4, the toner image forming part power source 12, the motor power source 13, and the heater power source 15.

In FIG. 2, upon a receipt of a print instruction, the print controller 10 drives the sheet carrying motor 14 (not illustrated) such that the sheet 1 is carried to the toner image forming part 5 by the hopping roller 2 and the sheet carrying parts 3*a* and 3*b* so as to match a timing of image formation. The LED head 4 radiates recording light corresponding to print information to the toner image forming part 5, and the toner image forming part 5 forms a toner image corresponding to the radiated recording light on the sheet 1. After that, the sheet 1 is carried to the fuser 6 by the sheet carrying parts 3*b* and 3*c*. The fuser 6 receives the sheet 1 on which a toner image to be fused is formed in the nip part N, fuses the toner image on the sheet 1 by applying heat and pressure, then ejects the sheet 1 on which an image is fused by the sheet carrying parts 3*c* and 3*d*, and finishes the image forming actions.

(II) Actions of Fuser Control Device of Comparative Examples

Figure 7A:
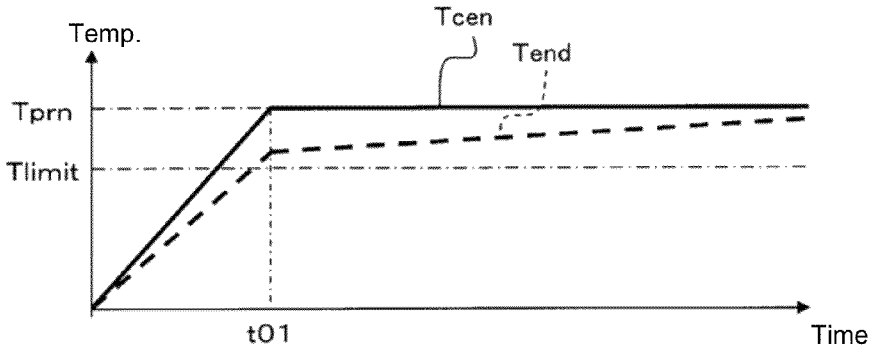
FIGS. 7A-7C explain temperature control of fusers of comparative examples and temperature change thereof.
Figure 7B:
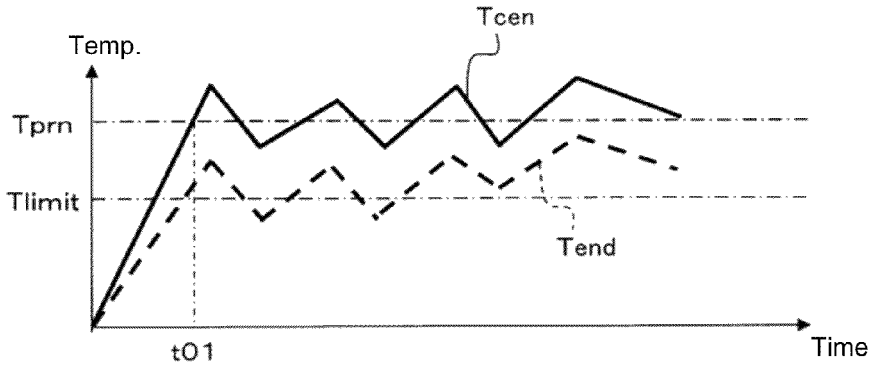
Figure 7C:
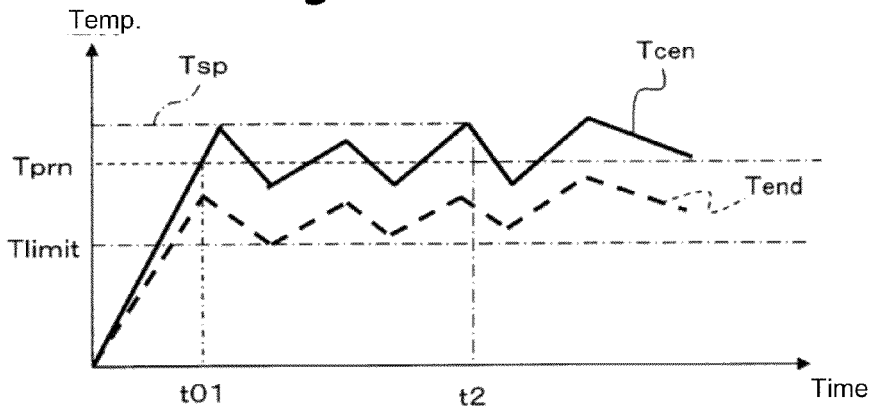

FIGS. 7A-7C explain temperature control of fusers of comparative examples and temperature change thereof.

FIG. 7A shows a temperature control and a temperature change when a heat capacity of the heat application roller 19 is large; FIG. 7B shows a temperature control and a temperature change when a heat capacity of the heat application roller 19 is small; and FIG. 7C shows an improved temperature control and an improved temperature change when a heat capacity of the heat application roller 19 is small.

First, in a case when a heat capacity is large, which is shown in FIG. 7A, because a heat capacity of the heat application roller 19 is large, quantity of heat supplied from the halogen heater 18A is first accumulated in the heat application roller 19. As a result, when the sheet 1 reaches the fuser 6 and contacts the heat application roller 19 during printing, the accumulated quantity of heat is supplied from an outer surface of the heat application roller 19 to the sheet 1. At the same time, in the heat application controller 11, the halogen heater 18A is driven, so that a quantity of heat is supplied from the halogen heater 18A to the heat application roller 19. And the quantity of heat is also first accumulated in the heat application roller 19, and then supplied to the sheet 1. As a result, in the heat quantity transfer via the heat application roller 19, change in a surface temperature of the heat application roller 19 is small because a rapid change is suppressed due to the accumulated heat quantity of the heat application roller 19.

Furthermore, a heat generation quantity of the halogen heater 18A is set to be larger at the end part than the central part, so the end part temperature Tend of the sheet 1 gradually approaches the central part temperature Tcen as printing is continued. Because the change in the end part temperature of Tend of the sheet 1 is small, for example when a temperature of Tend exceeds a lower limit temperature Tlimit at an initial print time t01, the temperature doesn't fall below the lower limit temperature Tlimit afterward.

Next, in a case when a heat capacity is small, which is shown in FIG. 7B, when the control the same as the one shown in FIG. 7A is performed to the heat application roller 19, an increasing rate of a surface temperature of the heat application roller 19 becomes high because the heat capacity is small. Furthermore, as a print speed becomes faster, number of the sheet 1 passing through per unit time becomes larger, so that a heat quantity released from the heat application roller 19 per unit time becomes larger. Therefore, when the halogen heater 18A is turned off, a large quantity of heat is released from the heat application roller 19. In the fuser 6 having a small heat capacity, a surface temperature is rapidly decreased because an accumulated heat quantity of the inside of the fuser 6 is small.

In order to handle the rapid decrease of the surface temperature, the heat generation quantity of the halogen heater 18A is set to be large. On the other hand, as temperature control, the halogen heater 18A is turned off when the temperature reached a predetermined temperature, and the halogen heater 18A is turned on when the temperature reached a predetermined temperature. As a result, in the image forming apparatus having a small heat capacity and a higher print speed, a change in the end part temperature Tend of the sheet 1 becomes large. The judgment of the predetermined temperature is performed based on the temperature Tcen of the central part.

As a measure to decrease a change in the end part temperature Tend of the sheet 1, it may be considered to control the halogen heater 18A to be turned on/off more frequently. However, the measure has a side effect that gives noise such as flicker noise to another electronic device connected by the same power source line, so the measure is not good enough. As an alternative one, another measure to set a target temperature to be higher than the lower limit temperature Tlimit that doesn't cause fusing deficiency may be considered so as not to cause fusing deficiency even when a change in the end part temperature is accepted. However, power consumption becomes large when the target temperature is set high so that the measure doesn't meet a recent trend of energy saving.

Next, in an improved temperature control and temperature change shown in FIG. 7C, a target temperature Tsp from a start of the temperature control to a time t2 is set to be a print temperature Tprn+a constant temperature ΔT, and a target temperature Tsp from the time t2 is set to get lower. In this method of temperature control, as compared to FIGS. 7A and 7B, it is possible to shorten a time period that the end part temperature Tend of the sheet 1 is increased to the lower limit temperature Tlimit or higher and provide a fuser control device and an image forming apparatus that enable lower power consumption.

However, in the comparative examples of FIGS. 7A-7C, the temperature Tside that is a temperature of the not-passage region of the fuser 6 has not been taken in consideration. As a result, the fuser 6 needs to be heated with certain play to cover that the temperature Tside of the not-passage region is not considered, so that there is a possibility remaining to acquire even lower power consumption. Therefore, hereinafter, explanations are given of actions of the fuser control device of the first example of the present invention that has achieved even lower power consumption as the temperature Tside of the fuser 6 in the not-passage region is considered.

(III) Correlation of Temperature Differences of Fuser 6 in FIG. 3

Figure 8A:
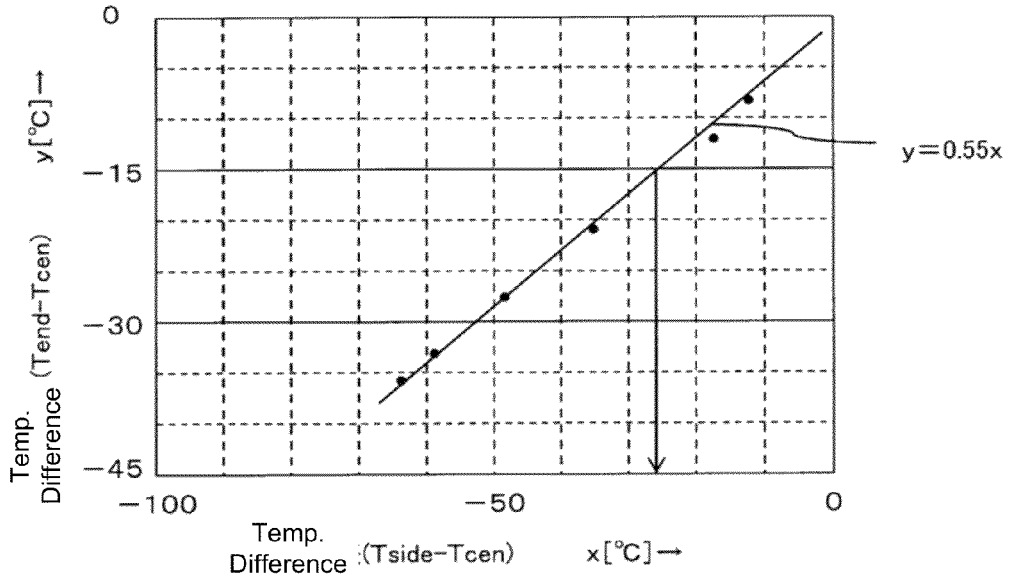
FIGS. 8A and 8B show correlations between two different temperature differences of the fuser 6 in FIG. 3.
Figure 8B:
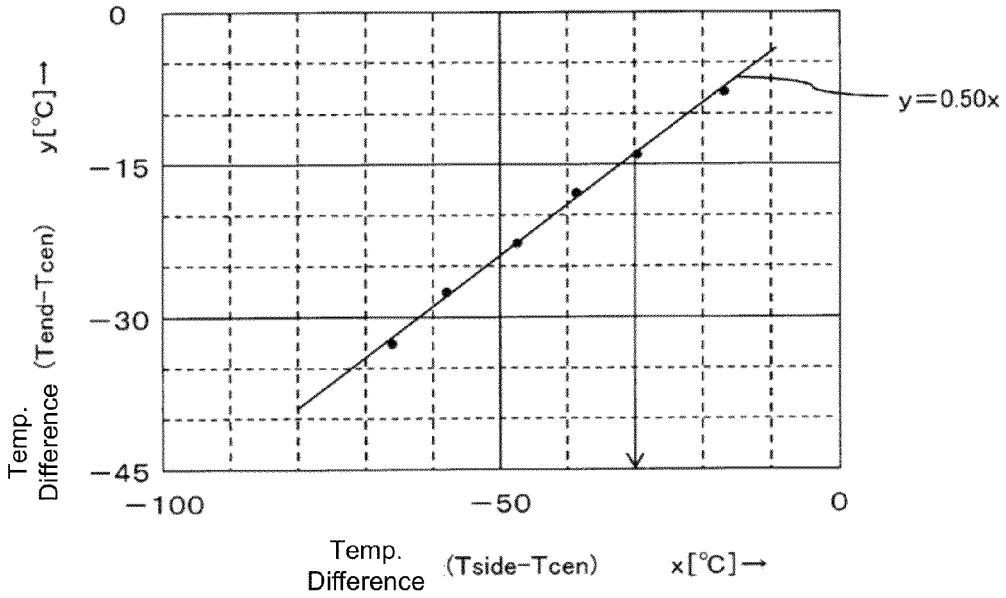

FIGS. 8A and 8B show correlations between two different temperature differences of the fuser 6 in FIG. 3.

FIG. 8A shows a correlation between a difference (x) between the second detection temperature Tside of the fuser 6 during warm-up and the first detection temperature Tcen and a difference (y) between the end part temperature Tend of the sheet 1 and the first detection temperature Tcen. FIG. 8B shows a correlation between a difference (x) between the second detection temperature Tside of the fuser 6 during printing and the first detection temperature Tcen and a difference (y) between the end part temperature Tend of the sheet 1 and the first detection temperature Tcen. The end part temperature Tend of the sheet 1 is obtained by contacting the sheet end part to a thermistor, adding it, and measuring experimentally correlations of some parts.

Points plotted on FIGS. 8A and 8B are experimental data at a room temperature of 25° C., and there is a positive primary/linear correlation between x and y. According to FIG. 8A, a correlation between x and y during warm-up is y=0.55x, and according to FIG. 8B, a correlation between x and y during printing is y=0.50x.

Here, a reason why the correlation described above is obtained is described. Heat supplied by the halogen heater 18A is transferred from the central part of the heat application roller 19 to the housing KT via the end part of the heat application roller 19, the not-passage region of the heat application roller 19 where the side thermistor 17 is disposed, and the holding member 21 of the heat application roller 19. Heat resistances of the parts are a unique constant value that is determined based on a thickness and length of the member of the heat application roller 19, and characteristics of materials such as thermal conductivity. Then, because a quantity of heat of this transferred heat is in proportion to a temperature difference, the transferred quantity of heat is in proportion to a difference between the temperature Tcen of the central thermistor 16 and the temperature Tside of the side thermistor 17. The correlation between the temperature difference (Tside-Tcen) and the temperature difference (Tend-Tcen) is obtained because the heat resistance is constant. The linear correlation coefficient $\alpha 1$ is different between one at the time of warm-up (before fusing) and one at the time of printing (during fusing). As described above, a coefficient $\alpha 1$ at the time of warm-up is $\alpha 1=0.55$, and a coefficient $\alpha 1$ at the time of printing is $\alpha 1=0.50$. This is because an apparent heat resistance varies between one at the time of warm-up when the sheet 1 doesn't exist and one at the time of printing when the sheet 1 exists because the side thermistor 17 is in the not-passage region.

In general, when the linear correlation coefficient of the temperature difference (y) between the end part temperature Tend of the sheet 1 and the first detection temperature Tcen to the temperature difference (x) between the second detection temperature Tside and the first detection temperature Tcen is represented by al, it is shown with a following equation (1).

$$(T\text{end}-T\text{cen})=\alpha 1\times(T\text{side}-T\text{cen}) \quad (1)$$

Solving the equation (1) for the end part temperature Tend of the sheet 1, $$T\text{end}=\alpha 1\times(T\text{side}-T\text{cen})+T\text{cen} \quad (2)$$

Furthermore, the primary correlation coefficient $\alpha 1$ is expressed as follows:

$$\alpha 1=(T\text{end}-T\text{cen})/(T\text{side}-T\text{cen}) \quad (3).$$

In the heat application controller 11, when the first detection temperature Tcen output from the central thermistor 16 and the second detection temperature Tside output from the side thermistor 17 are input, it is possible to calculate the end part temperature Tend of the sheet 1.

Here, $\alpha 1=0.55$ for warm-up and $\alpha 1=0.50$ for printing that were obtained by the experiment are saved in a memory (not illustrated) in the heat application controller 11.

Next, a method of setting a switch temperature Tcold1 is explained. The inventor found that fusing deficiency doesn't occur from a rule of thumb when a temperature difference between the temperature Tcen of the central part of the fuser 6 and the end part temperature Tend of the sheet 1 is 15° C. or less. According to the rule of thumb, fusing deficiency may occur when the end part temperature Tend of the sheet 1 is more than 15° C. higher than the temperature Tcen of the central part.

From the first detection temperature Tcen of the central thermistor 16 and the second detection temperature Tside of the side thermistor 17, a condition that fusing deficiency occurs at the end part of the sheet 1 is obtained, and a condition temperature thereof is referred to as a switch temperature Tcold1. The temperature difference between the temperature Tcen of the central part and the end part temperature Tend of the sheet 1 exceeds the switch temperature Tcold1, it is required to correct the target temperature Tsp higher.

The switch temperature Tcold1 is calculated from a following expression (4).

$$T\text{cold}1=-15+\alpha 1 \quad (4)$$

When the switch temperature Tcold1 is calculated from the expression (4) based on $\alpha 1$ obtained from FIGS. 8A and 8B, a switch temperature Tcold1 for warm-up is −27° C. and a switch temperature Tcold1 for printing is −30° C.

(IV) Actions of Fuser Control Device of First Example

Upon that the print controller 10 receives a print instruction, the sheet carrying parts 3*a*-3*d* rotatably drive the heat application roller 19 via a gear (not illustrated). Then, a temperature of the heat application roller 19 obtained by correcting a result Tcen detected by the central thermistor 16 of the fuser 6 is judged if the temperature is within a predetermined printable temperature range, and if it is within the range, carrying of the sheet 1 is started. Herein, the printable temperature range is a temperature range that toner can be properly fused on the sheet 1, and has Tlimit as a lower limit temperature and T2 as an upper limit temperature. The lower limit temperature Tlimit is 160° C. for example, and the upper limit temperature T2 is 200° C. for example.

When the surface temperature Tcen of the heat application roller 19 is higher than the upper limit temperature T2, the heat application controller 11 stops power supply from the heater power source 15 to the halogen heater 18A to decrease the temperature of the heat application roller 19 (hereinafter, this is referred to as "cool-down.") When the surface temperature Tcen of the heat application roller 19 is lower than the lower limit temperature Tlimit, the heat application controller 11 performs power supply from the heater power source 15 to the halogen heater 18A to increase the temperature Tcen of the heat application roller 19 (hereinafter, this is referred to as "warm-up.")

Figure 9:
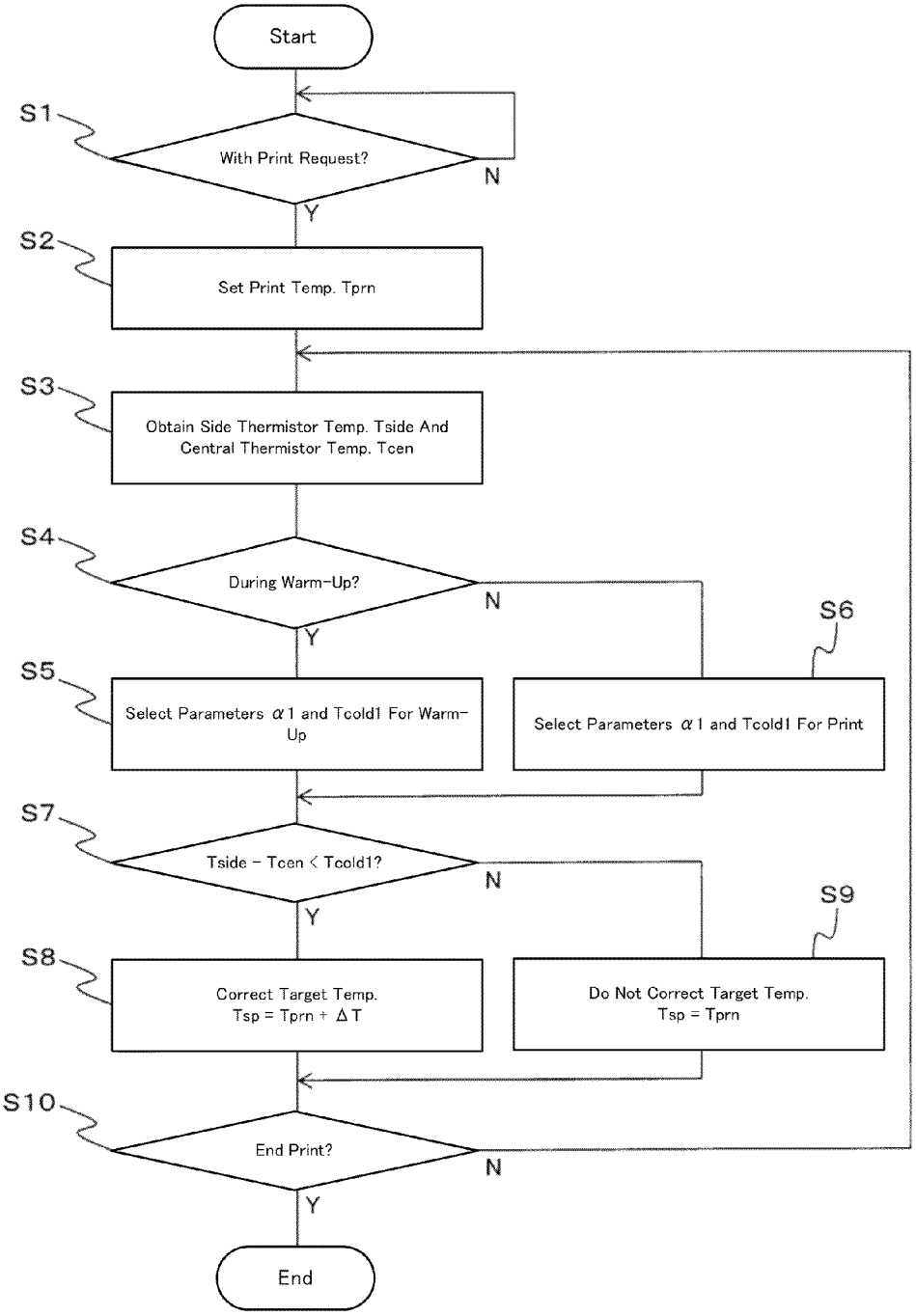
FIG. 9 is a flow diagram that shows a process of temperature control of the fuser 6 in FIG. 1.

FIG. 9 is a flow diagram that shows a process of temperature control of the fuser 6 in FIG. 1. As referring to FIGS. 1-6B and 8A-8B, along a flow in FIG. 9, actions of the fuser control device of the first example is explained below.

Once the temperature control of the fuser 6 in FIG. 1 starts, it proceeds to S1. In S1, the print controller 10 detects occurrence of a print request from a host (not illustrated), and once the print request is detected (Y), it proceeds to S2. In S2, the print controller 10 sends a print request content from the host to the heat application controller 11. The heat application controller 11 sets a proper temperature judged from information from the print controller 10 as a print temperature Tprn, and starts a temperature control on the heat application roller 19 such that a surface temperature Tcen of the heat application roller 19 becomes the print temperature T, and then it proceeds to S3. Herein, the print temperature Tprn is an optimum setting temperature for various print conditions, and is a temperature at which print can be executed without problems when a temperature difference between one at the central part and one at the end part is 15° C. or less. The print temperature Tprn is experimentally obtained in advance, and is saved in a memory (not illustrated) in the print controller 10. Note, the temperature difference between the central part and the end part is a value determined based on a structure of the fuser 6, and is experimentally obtained.

In S3, the heat application controller 11 obtains the first detection temperature Tcen and the second detection temperature Tside from the central thermistor 16 and the side thermistor 17, and it proceed to S4. In S4, the heat application controller 11 judges if it is currently during warm-up or during printing by checking if the first detection temperature Tcen is within the print startable temperature range. When the judgment is during warm-up (Y), it proceeds to S5, and when judgment is during printing (N), it proceeds to S6.

In S5, the heat application controller 11 selects a coefficient α1 (for example, 0.55) and a switch temperature Tcold1 (for example, −27° C.) for warm-up, and then it proceeds to S7. In S6, when the judgment is currently during printing, the heat application controller 11 selects a coefficient α1 (for example, 0.50) and a switch temperature Tcold1 (for example, −30° C.) for printing, and then it proceeds to S7.

In S7, the heat application controller 11 compares the temperature difference between the second detection temperature Tside and the first detection temperature Tcen with the switch temperature Tcold1 selected at S5 or S6. In a case of Tside−Tcen<Tcold1 (Y), the fuser 6 is judged to be at a low temperature, and it proceeds to S8. In a case of Tside−Tcen≥Tcold1 (N), the fuser 6 is judged to be sufficiently heated, and it proceeds to S9. In S9, the heat application controller 11 doesn't perform a correction of the target temperature Tsp, and set the target temperature Tsp to be the target temperature Tsp=the print temperature Tprn, and then it proceeds to S10.

In S8, the heat application controller 11 corrects the target temperature Tsp to be the print temperature+ΔT, and then it proceeds to S10.

Herein, the correction value ΔT of the target temperature Tsp is obtained with a following expression.

$$\Delta T = -1 \times (Tend - Tcen) + 15$$
$$= -0.55 \times (Tside - Tcen) + 15$$

The corrected target temperature Tsp is expressed as follows.

$$Tsp = Tprn + \Delta T = Tprn - 0.55 \times (Tside - Tcen) + 15$$

Herein, in a case of, for example, the print temperature Tprn=180° C., the first detection temperature Tcen=160° C., and the second detection temperature Tside=110° C., the target temperature Tsp is expressed as follows.

$$Tsp = 180 + \{-0.55 \times (110 - 160) - 15\} = 193° \text{ C.}$$

In the correction of the target temperature Tsp, when the temperature difference between the central thermistor 16 and the side thermistor 17 is larger, the fuser 6 is judged to be cooled more, so that the target temperature Tsp is corrected to be higher. This is because a temperature of the holding member 21 that holds the heat application roller 19 is judged to be low when the temperature difference is large. When the temperature of the holding member 21 is low, it causes a phenomenon that a temperature of the end part of the heat application roller 19 becomes low because a heat quantity releasing from the end part of the heat application roller 19 contacted and held by the holding member 21 is large. In order to compensate the temperature decrease, the target temperature Tsp is set to be high.

In S10, when the print controller 10 doesn't receive an order of print end (N), it goes back to S3. Until an order of print end is received in S10, a process of S3-S10 is repeated. In S10, when an order of print end is received (Y), the print controller 10 ends the process of the temperature control.

Figure 10:
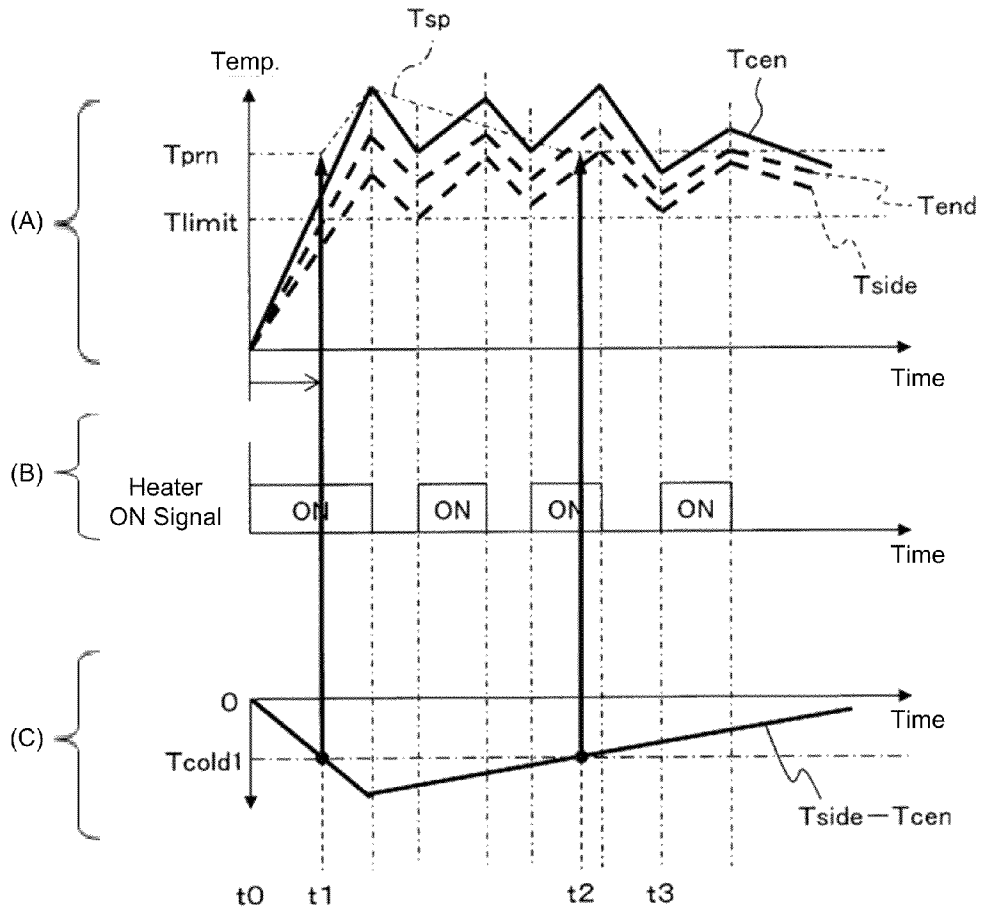
FIG. 10 explains temperature control of the fuser 6 in FIG. 3 and temperature changes thereof.

FIG. 10 explains temperature control of the fuser 6 in FIG. 3 and temperature changes thereof when a print request is received in a state where the fuser 6 is cooled to a room temperature.

A section A in FIG. 10 shows temporal changes of the target temperature Tsp, the first detection temperature Tcen of the central part of the fuser 6, the second detection temperature Tside of the not-passage region of the fuser 6, and the end part temperature Tend of the sheet 1. A section B of FIG. 10 shows a temporal change of a heater on signal. A section C of FIG. 10 shows a temporal change of the temperature difference obtained by subtracting the first detection temperature Tcen from the second detection temperature Tside.

At the time of t0, temperatures of the parts of the fuser 6 are a room temperature that is lower than the lower limit temperature Tlimit. When the print control part 10 receives the print request from this situation, the heat application controller 11 starts a heat application control on the heat application roller 19, and the temperatures Tcen, Tside, and Tend start to increase.

At the time of t1, the heat application controller 11 detects that the temperature difference between the second detection temperature Tside of the side thermistor 17 and the first detection temperature Tcen of the central thermistor 16 is lower than the switch temperature Tcold1, and the target temperature Tsp starts to be corrected. As a result, the heat application controller 11 controls such that the surface temperature Tcen of the heat application roller 19 becomes a target temperature Tprm+ΔT higher than the print temperature Tprn. When the temperature increases and reaches the print startable temperature range, the print controller 10 starts the print process.

The heat application controller 11 continues a driving control of the halogen heater 18A, and controls the temperature Tcen of the central part of the fuser 6 to be the target temperature Tsp. The heat application controller 11 continues a comparison judgment of the temperature deference between the first detection temperature Tcen of the central thermistor 16 and the second detection temperature Tside of the side thermistor 17 and the switch temperature Tcold1, and calculation of a correction value AT of the target temperature Tsp.

At the time of t2, the heat application controller 11 detects that the temperature difference between the second detection temperature Tside of the side thermistor 17 and the first detection temperature Tcen of the central thermistor 16 is higher than the switch temperature Tcold1, and corrects the target temperature Tsp back to the print temperature Tprn. As long as the temperature difference is higher than the switch temperature Tcold1, the target temperature Tsp is fixed to the print temperature Tprn.

At the time of t3, the end part temperature Tend of the sheet 1 is maintained to a temperature that is sufficiently high not to cause fusing deficiency. Therefore, even if the correction of the target temperature Tsp is stopped, the end part temperature Tend of the sheet 1 doesn't fall below the lower limit temperature Tlimit, and fusing deficiency doesn't occur.

The print start time of FIG. 10 until the end part temperature Tend of the sheet 1 exceeds the lower limit temperature Tlimit and print can be started is shorter than any print start time of FIGS. 7A-7C. As FIG. 10 that shows the first example is compared with FIG. 7C that shows the comparative example, in FIG. 10, the target temperature Tsp during a period of Tside−Tcen<Tcold1 is variably controlled. On the other hand, in FIG. 7C, the target temperature Tsp is set to be a constant temperature ΔT higher from the start of the temperature control to the time t2. As a result, the temperature control of the first example achieves lower power consumption as compared to the temperature control of the comparative example shown in FIG. 7C.

Figure 11:
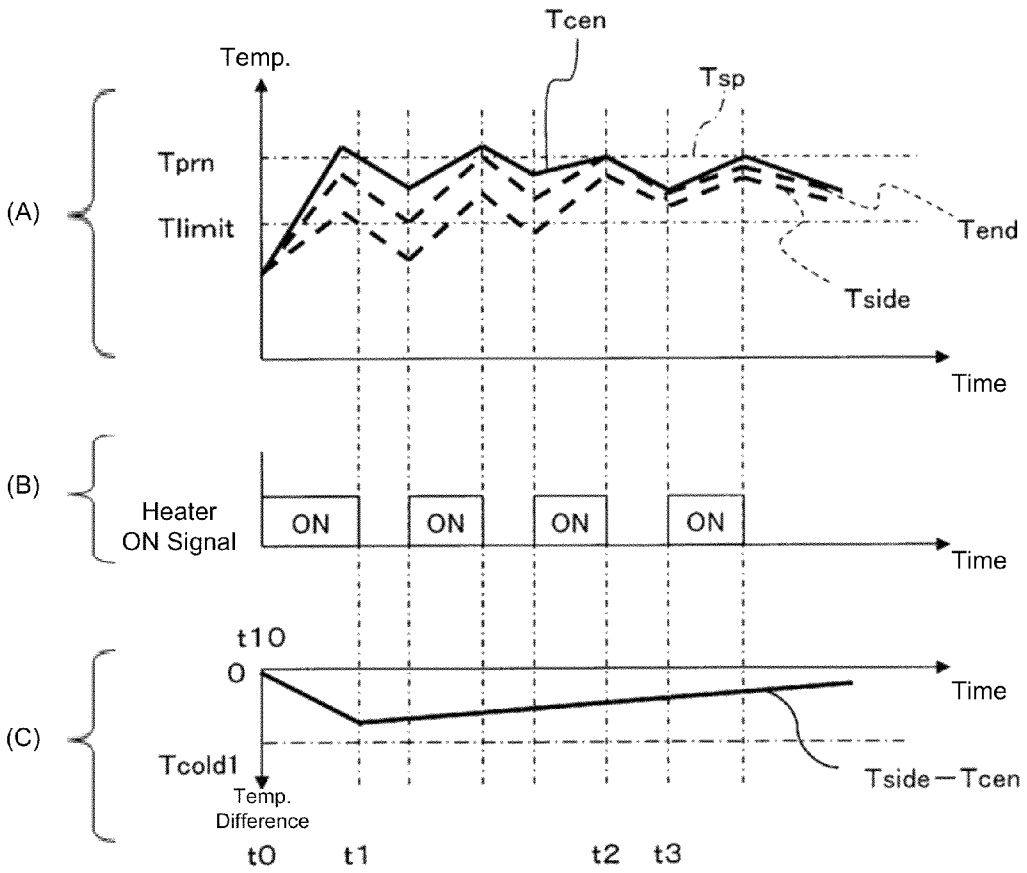
FIG. 11 explains temperature control of the fuser 6 in FIG. 3 and temperature changes thereof.

FIG. 11 explains temperature control of the fuser 6 in FIG. 3 and temperature changes thereof when a print request is received in a state where the fuser 6 is sufficiently heated.

A section A in FIG. 11 shows temporal changes of the target temperature Tsp, the temperature Tcen of the central part of the fuser 6, the temperature Tside of the not-passage region of the fuser 6, and the end part temperature Tend of the sheet 1. A section B of FIG. 11 shows a temporal change of a heater on signal. A section C of FIG. 11 shows a temporal change of the temperature difference obtained by subtracting the first detection temperature Tcen from the second detection temperature Tside.

At the time of t0, the temperature difference between the first detection temperature Tcen of the central thermistor 16 and the second detection temperature Tside of the side thermistor 17 is smaller than the switch temperature Tcold1. So that, the target temperature Tsp is fixed to the print temperature Tprn, and correction is not performed.

At the time of t1, the fuser 6 is still sufficiently heated. Therefore, the temperature deference between the central part and the end part is sufficiently small, the end part temperature Tend of the sheet 1 doesn't fall below the lower limit temperature Tlimit over the time t1-t3, and fusing deficiency doesn't occur.

Effects of First Example

According to the first example, following effects (1) and (2) are obtained.

(1) The heat application controller 11 performs a correction of the target temperature Tsp according to the temperature deference between the first detection temperature Tcen of the central thermistor 16 disposed in the passage region on the fuser 6 where the sheet 1 passes through and the second detection temperature Tside of the side thermistor 17 disposed in the not-passage region. As a result, even when print starts from a situation where the fuser 6 is sufficiently cooled, occurrence of fusing deficient at the end part of the sheet 1 can be prevented.

(2) The target temperature Tsp is corrected to be higher to the minimum necessary only when the end part temperature Tend of the sheet 1 is low. Therefore, print can be executed with minimum necessity of power consumption, so that increase of unnecessary power consumption can be prevented.

Second Example

Configuration of Second Example

A schematic structure of an image forming apparatus of a second example of the present invention is the same as the one shown in FIG. 2, which shows the first example.

Figure 12:
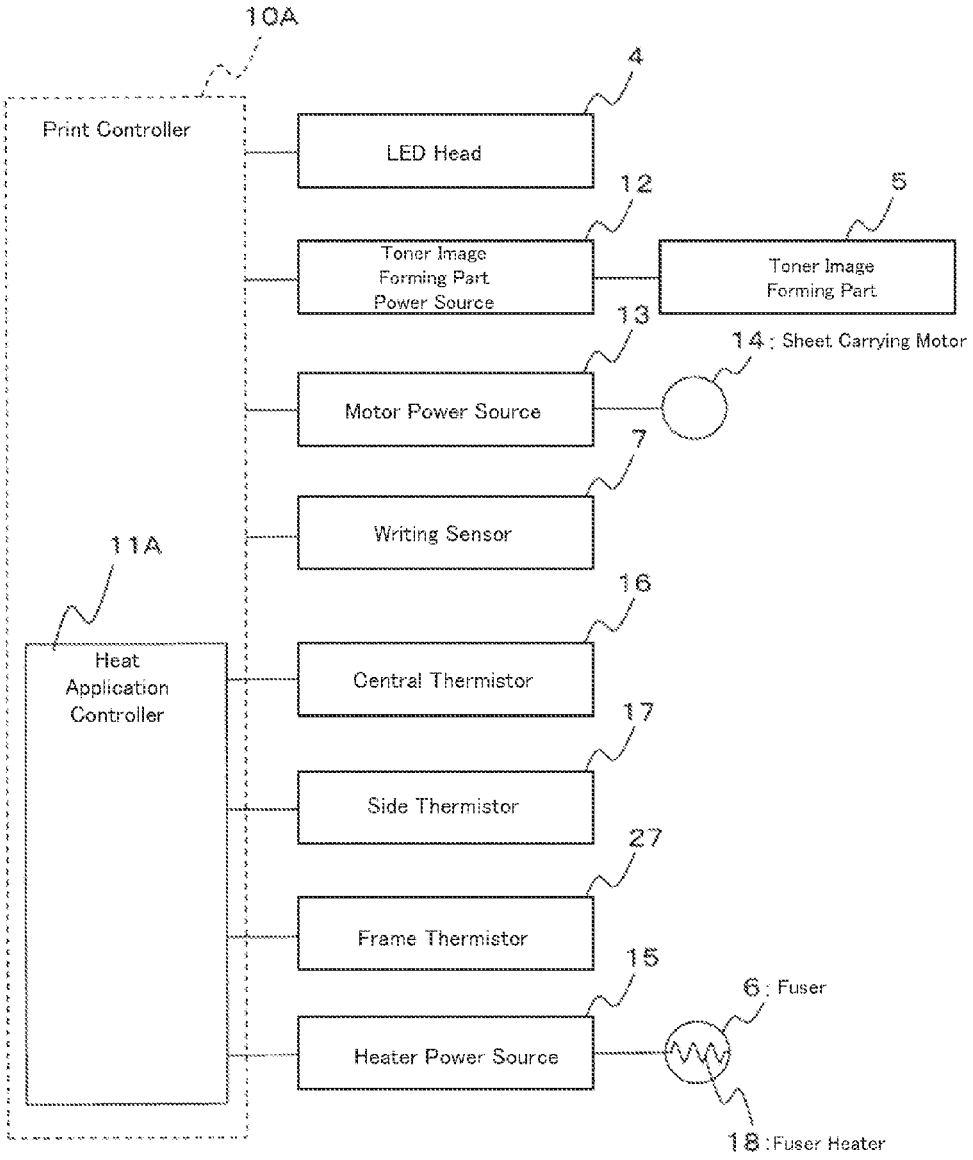
FIG. 12 is a block diagram that shows a schematic configuration of an image forming apparatus of a second embodiment of the present invention.

FIG. 12 is a block diagram that shows a schematic configuration of the image forming apparatus of the second example of the present invention, and the same reference numbers are given to elements that are common with the ones in FIG. 1, which shows the first example.

The image forming apparatus of the present second example has a print controller 10A that controls entire print movement and has a different function from the one of the first example. The print controller 10A incorporates a heat application controller 11A that performs a heat control on a temperature of the fuser 6 and has a different function from the one of the first example.

The heat application controller 11A are connected to the heater power source 15, the central thermistor 16, and the thermistor 17, which are the same as the ones of the first example, and furthermore, is connected to a frame thermistor 27 that works as a third temperature detection part. The frame thermistor 27 detects a temperature of the holding member 21 that holds the fuser 6, and outputs a third detection temperature Tamb. The heat application controller 11A performs an on/off control on the heater power source 15 that supplies power to the halogen heater 18A to perform a temperature control on the fuser 6.

A fuser control device of the second example is configured with the heat application controller 11A, the heater power source 15, the halogen heater 18A, the fuser 6, the central thermistor 16, the side thermistor 17, and the frame thermistor 27.

Figure 13:
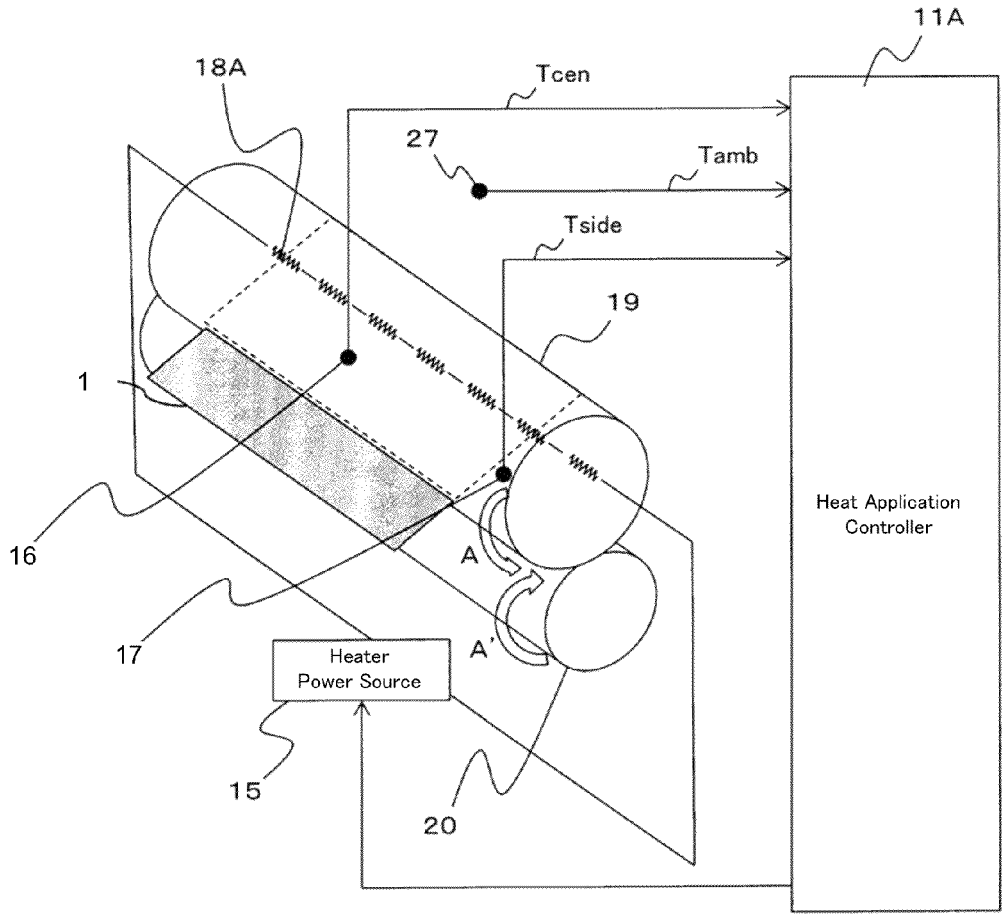
FIG. 13 is a perspective view that explains an overview of temperature control of a fuser 6 in FIG. 12.

FIG. 13 is a perspective view that explains an overview of temperature control of the fuser 6 in FIG. 12, and the same reference numbers are given to elements that are common with ones in FIG. 3, which shows the first example.

In the fuser control part of the second example, the frame thermistor 27 is newly added to the fuser control part of the first example, shown in FIG. 3. The frame thermistor 27 is firmly attached by something such as a screw to the holding member 21 (not illustrated) that holds the fuser 6, and detects a temperature of the holding member 21 and outputs the temperature to the heat application controller 11A as a third detection temperature Tamb.

The heat application controller 11A corrects the target temperature Tsp based on the third detection temperature Tamb, and outputs a control signal to perform an on/off control on the switch 15*a* in the heater power source 15 such that the temperature of the fuser 6 becomes the corrected target temperature Tsp based on the first detection temperature Tcen and the second detection temperature Tside.

Other configuration of the fuser control device and the image forming apparatus of the second example are the same as the configuration of the first example.

Actions of Second Examples

Actions of the image forming apparatus of the second example are the same as the image forming apparatus of the first example, so that its explanation is omitted.

In actions of the second example, an explanation consisting of: (I) Relationship between a third detection temperature Tamb and a primary/linear correlation coefficient $\alpha 2$, and a switch temperature Tcold2; and (II) Actions Of Fuser Control Device Of Second Example is given.

(I) Relationship Between A Third Detection Temperature Tamb And A Primary Correlation Coefficient A2, And A Switch Temperature Tcold2

Figure 14A:
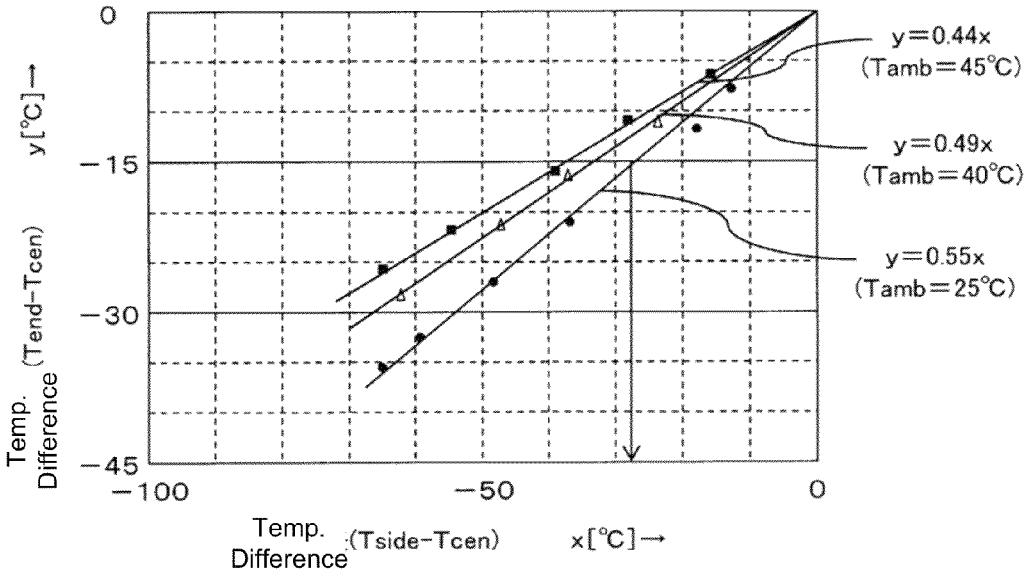
FIGS. 14A and 14B show correlations between two different temperature differences during warm up of the fuser 6 in FIG. 12.
Figure 14B:
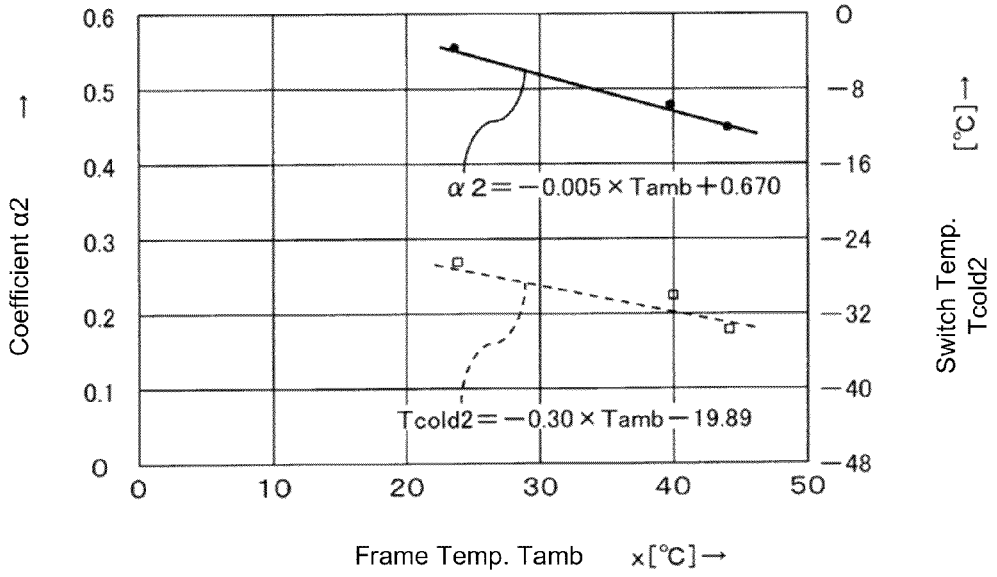

FIGS. 14A and 14B show correlations between two different temperature differences during warm-up of the fuser 6 in FIG. 12.

FIG. 14A shows a correlation between a difference (x) between the second detection temperature Tside of the fuser 6 during warm-up and the first detection temperature Tcen when the frame temperatures Tamb as the third detection temperature are Tamb=25° C., 40° C., and 45° C., and a difference (y) between the end part temperature Tend of the sheet 1 and the first detection temperature Tcen. FIG. 14B shows the change in the primary correlation coefficient α2 to the frame temperature Tamb and a switch temperature Tcold2.

Points plotted on FIG. 14A were experimental data when the frame temperatures were Tamb=25° C., 40° C., and 45° C. Respective primary correlation coefficients α2 when the frame temperatures were Tamb=25° C., 40° C., and 45° C. were 0.5, 0.49, and 0.44. It can be found that the higher frame temperature Tamb corresponds to the lower value of the primary correlation coefficient α2.

In FIG. 14B, the primary correlation coefficients α2 per frame temperature Tamb obtained in FIG. 14A and switch temperatures Tcold2 obtained by plugin α2 in the above described expression (4) are plotted with respect to the frame temperature Tamb. When a straight line approximation is performed on the plotted points, the coefficient α2 with respect to the frame temperature Tamb is expressed as follows.

$$\alpha 2=-0.005\times Tamb+0.670 \quad (5)$$

The switch temperature Tcold2 with respect to the frame temperature Tamb is expressed as follows.

$$Tcold2=-0.30\times Tamb-19.89 \quad (6)$$

Figure 15A:
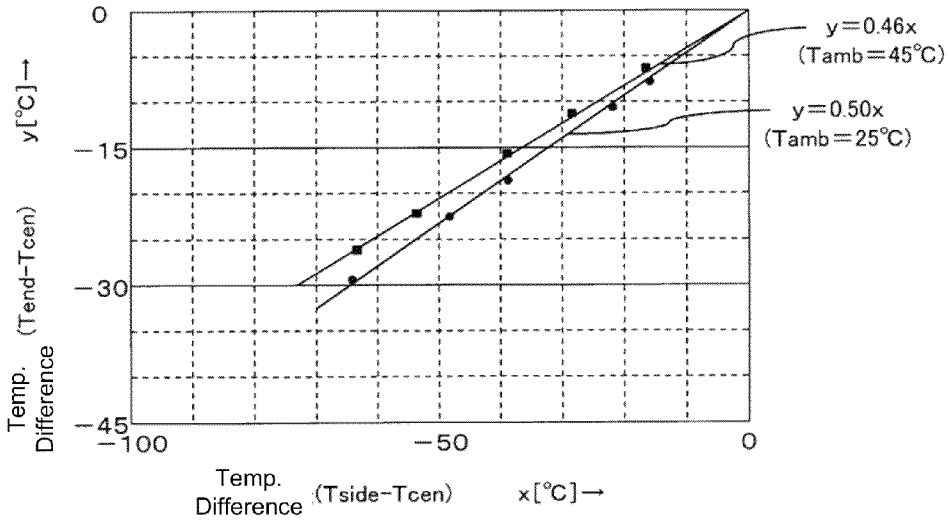
FIGS. 15A and 15B show correlations between two different temperature differences during printing of the fuser 6 in FIG. 12.
Figure 15B:
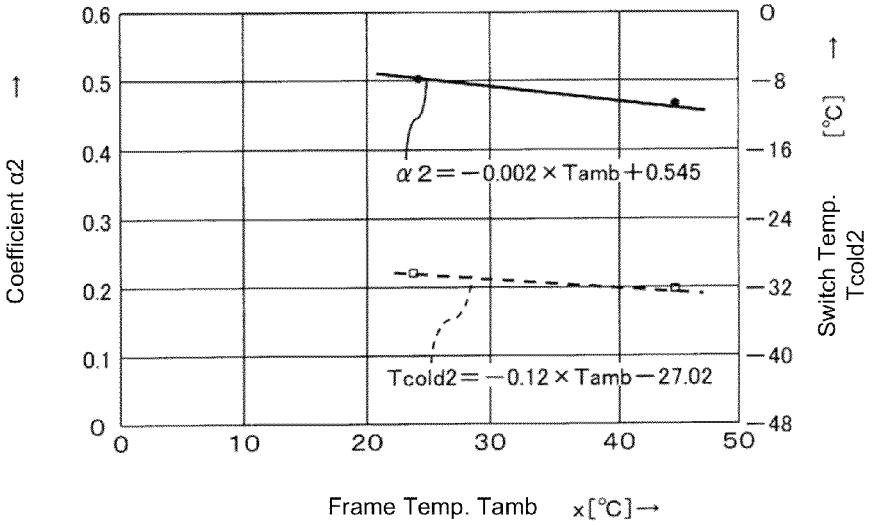

FIGS. 15A and 15B show correlations between two different temperature differences during printing of the fuser 6 in FIG. 12.

FIG. 15A shows a correlation between a difference (x) between the second detection temperature Tside of the fuser 6 during warm-up and the first detection temperature Tcen when the frame temperatures Tamb as the third detection temperature are Tamb=25° C., 40° C., and 45° C., and a difference (y) between a temperature T end part of the end part of the sheet and the first detection temperature Tcen. FIG. 15B shows the change in the primary correlation coefficient α2 to the frame temperature Tamb and the switch temperature Tcold2. Respective primary correlation coefficients α2 when the frame temperatures were Tamb=25° C. and 45° C. were 0.5 and 0.46. It can be found that the higher frame temperature Tamb has the lower value of the primary correlation coefficient α2.

In FIG. 15B, the primary correlation coefficients α2 per frame temperature Tamb obtained in FIG. 15A and switch temperatures Tcold2 obtained by plugin α2 in the above described expression (4) are plotted with respect to the frame temperature Tamb. When a straight line approximation is performed on the points plotted on the X-Y coordinate of FIG. 15B, the coefficient α2 with respect to the frame temperature Tamb is expressed as follows.

$$\alpha 2=-0.002\times Tamb+0.545 \quad (7)$$

The switch temperature Tcold2 with respect to the frame temperature Tamb is expressed as follows.

$$Tcold2=-0.12\times Tamb-27.02 \quad (8)$$

From the above described results, an optimum coefficient α2 and judgment temperature Tcold2 to a current frame temperature Tamb are obtained from the above described expressions (5)-(8).

When the frame temperature Tamb during warm-up is 22° C. for example, following α2 and Tcold2 are obtained from the expressions (5) and (6).

$$\alpha 2=-0.005\times 22+0.67=0.56$$

$$Tcold2=-0.3\times 22-19.89=-26.5^\circ C.$$

When the frame temperature Tamb is 45° C. for example, following α2 and Tcold2 are obtained in the same way.

$$\alpha 2=-0.005\times 45+0.67=0.445$$

$$Tcold2=-0.3\times 45-19.89=-33^\circ C.$$

When the frame temperature Tamb during printing is 22° C. for example, following α2 and Tcold2 are obtained from the expressions (7) and (8).

$$\alpha 2=-0.002\times 22+0.546=0.502$$

$$Tcold2=-0.12\times 22-27.02=-29.7^\circ C.$$

When the frame temperature Tamb is 45° C. for example, following α2 and Tcold2 are obtained in the same way.

$$\alpha 2=-0.002\times 45+0.546=0.456$$

$$Tcold2=-0.12\times 45-27.02=-32.4^\circ C.$$

(II) Actions of Fuser Control Device of Second Example

Figure 16:
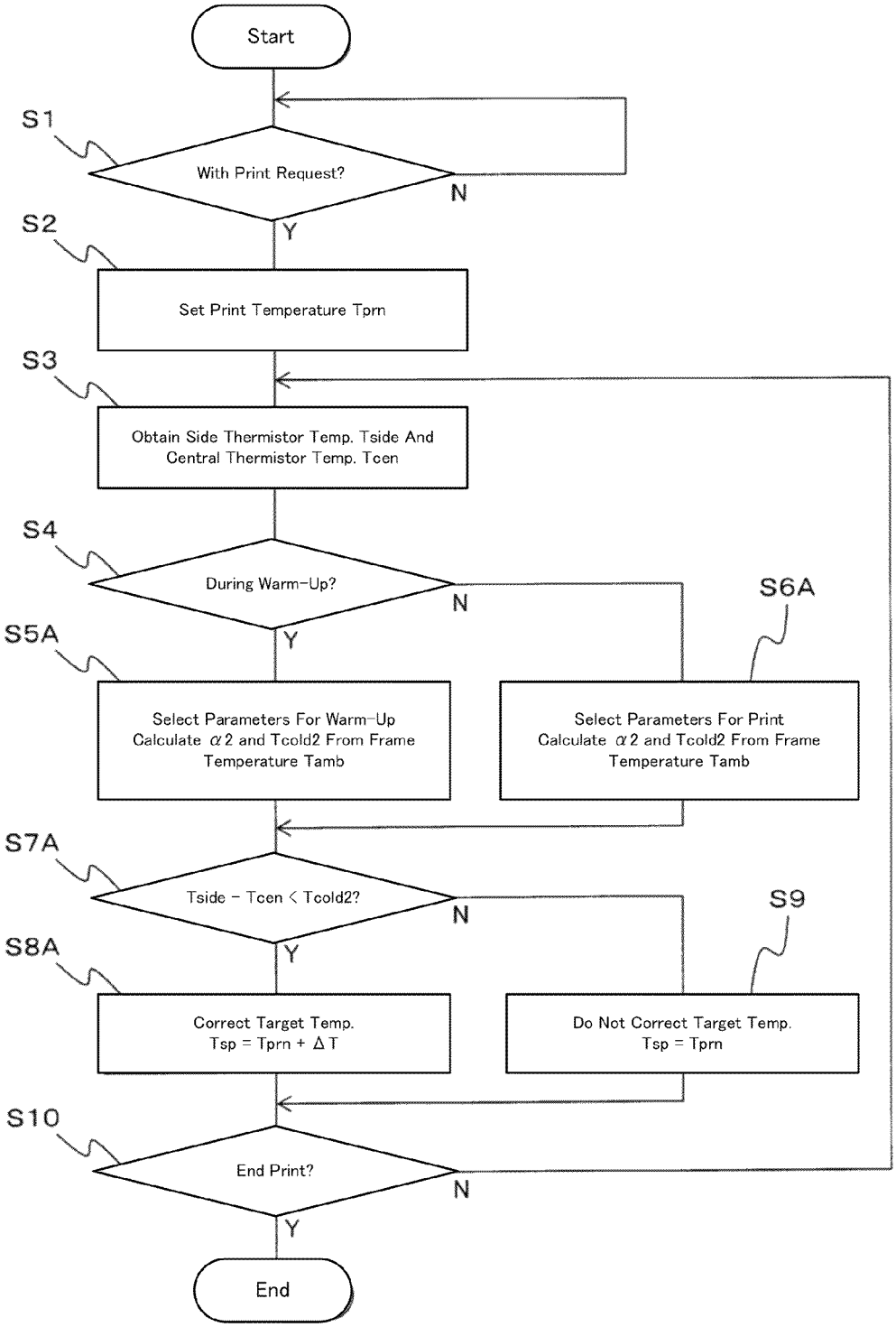
FIG. 16 is a flow diagram that shows a process of temperature control of the fuser 6 in FIG. 12.

FIG. 16 is a flow diagram that shows a process of temperature control on the fuser 6 in FIG. 12, and the same reference numbers are given to elements that are common with the ones in FIG. 9, which shows the first example.

Once the temperature control on the fuser 6 in FIG. 12 starts, it proceeds to S1. Then, the same process as S1-S3 in the flow diagram in FIG. 9 that shows the first example is executed, and it proceeds to S4. In S4, the heat application controller 11A judges if it is currently during warm-up or during printing by checking if the first detection temperature Tcen is within the print startable temperature range. When the judgment is during warm-up (Y), it proceeds to S5A, and when judgment is during printing (N), it proceeds to S6A.

In S5A, when the judgment is currently during warm-up, the heat application controller 11A selects a coefficient α2 and a switch temperature Tcold2 that are for warm-up and corrected based on the frame temperature Tamb, and then it proceeds to S7A. The coefficient α2 and the switch temperature Tcold2 that are for warm-up and corrected based on the frame temperature Tamb are calculated from the above described expressions (5) and (6).

In S6, when the judgment is currently during printing, the heat application controller 11A selects a coefficient α2 and a switch temperature Tcold2 for printing, and then it proceeds to S7A. The coefficient α2 and the switch temperature Tcold2 that are for printing and corrected based on the frame temperature Tamb are calculated from the above described expressions (7) and (8).

In S7A, the heat application controller 11A compares the temperature difference between the second detection temperature Tside and the first detection temperature Tcen with the switch temperature Tcold2 calculated at S5A or S6A. In a case of Tside−Tcen<Tcold2 (Y), the fuser 6 is judged to be at a low temperature, and it proceeds to S8A. In a case of Tside−Tcen≥Tcold2 (N), the fuser 6 is judged to be sufficiently heated, and it proceeds to S9.

In S8A, the heat application controller 11A corrects the target temperature Tsp to be a print temperature Tprn+ΔT using the coefficient α2 and the switch temperature Tcold2 calculated at S5A or S6A. The corrected temperature ΔT of the second example is given by a following expression (9).

$$\Delta T=\alpha 2\times(Tside-Tcen)+15 \quad (9)$$

Herein, in a case of, for example, the print temperature Tprn=180° C., the first detection temperature Tcen=160° C., and the second detection temperature Tside=110° C., and the frame temperature Tamb=22° C., the target temperature Tsp is expressed as follows, using the results at S5A.

$$Tsp=180+\{-0.56\times(110-160)-15\}=193^\circ C.$$

Also, when the frame temperature Tamb is 45° C. during warm-up, the target temperature Tsp is expressed as follows, using the results at S5A.

$$Tsp=180+\{-0.445\times(110-160)-15\}=183^\circ\text{ C.}$$

Also, when the frame temperature Tamb is 22° C. during printing, the target temperature Tsp is expressed as follows, using the results at S6A.

$$Tsp=180+\{-0.502\times(110-160)-15\}=190^\circ\text{ C.}$$

When the frame temperature Tamb is 45° C. during printing, the target temperature Tsp is expressed as follows, using the results at S6A.

$$Tsp=180+\{-0.456\times(110-160)-15\}=188^\circ\text{ C.}$$

According to the above-described results, it can be found that, with the higher frame temperature Tamb, the target temperature Tsp is corrected to be lower.

In S9 and S10, the same processes as the ones in the flow diagram in FIG. 9 are performed. In S10, the print controller 10 waits for an order of print end, receives an order of print end (Y), and then ends the process of the temperature control.

Figure 17:
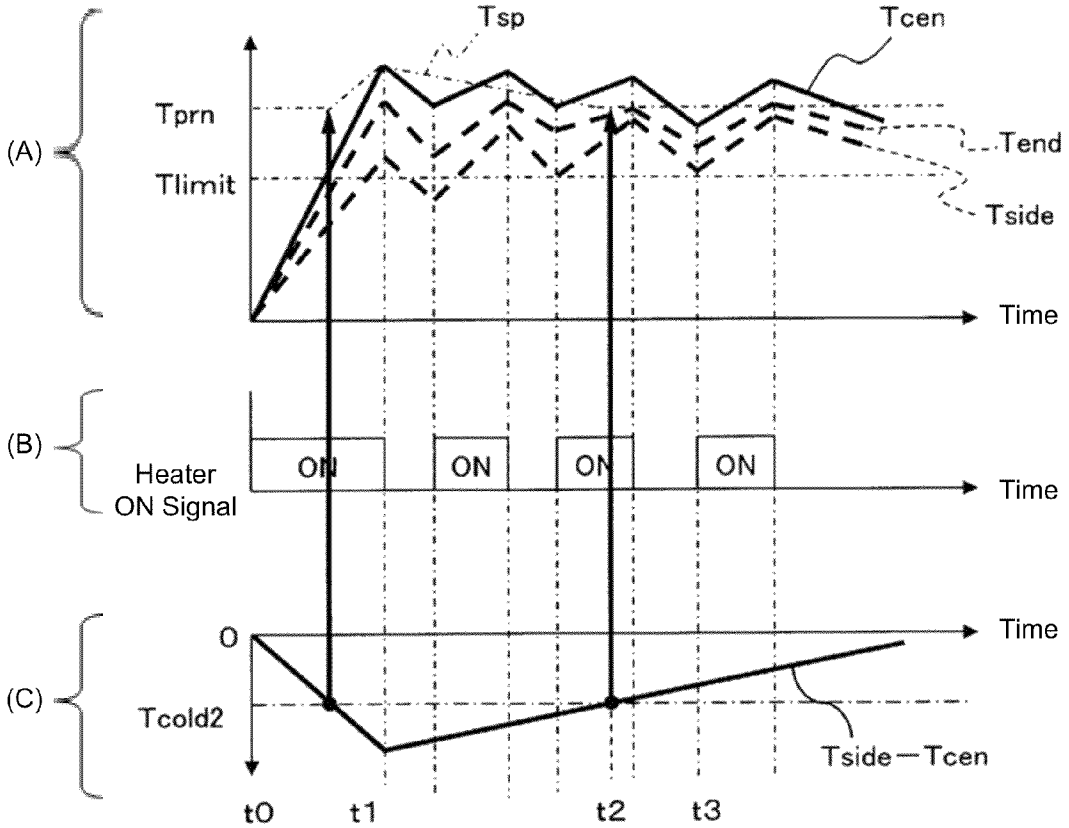
FIG. 17 explains temperature control of the fuser 6 in FIG. 12 and temperature changes thereof.

FIG. 17 explains temperature control of the fuser 6 in FIG. 12 and temperature changes thereof when the frame temperature is high, and corresponds to FIG. 10 that shows the first example.

A section A in FIG. 17 shows temporal changes of the target temperature Tsp, the temperature Tcen of the central part of the fuser 6, the temperature Tside of the not-passage region of the fuser 6, and the end part temperature Tend of the sheet 1. A section B of FIG. 17 shows a temporal change of a heater on signal. A section C of FIG. 17 shows a temporal change of the temperature difference obtained by subtracting the first detection temperature Tcen from the second detection temperature Tside.

When the target temperatures Tsp of the section A of FIG. 17 and the section A of FIG. 10 are compared, the target temperature Tsp in the section A of FIG. 17 is lower than the target temperature Tsp in the section A of FIG. 10. This is because in the second example the target temperature Tsp is corrected using the primary correlation coefficient α2 and the switch temperature Tcold2 calculated according to the frame temperature Tamb.

Effects of Second Example

According to the second example, the frame thermistor 27 that detects a temperature of the holding member 21 of the fuser 6 and outputs the third detection temperature Tamb is newly added, and the heat application controller 11A corrects the coefficient α2 and the switch temperature Tcold2 according to the third detection temperature Tamb, and corrects the target temperature Tsp based on the corrected coefficient α2 and switch temperature Tcold2. As a result, in addition to the effects of the first example, when the fuser 6 has a high temperature, it prevents the target temperature Tsp from being corrected to be unnecessarily high, and minimum necessity of correction on the target temperature Tsp is performed. Therefore, further reduction in power consumption can be achieved.

Modified Examples

Not limited to the first and second examples described above, various usage forms and modified examples are applicable. As the usage forms and modified examples, followings (1)-(5) for example are described.

(1) In the fuser 6 in the first and second examples, it is explained that the fuser heater 18 is the halogen heater 18A incorporated by the heat application roller 19 in a non-contact state. However, the fuser heater 18 is not limited to the halogen heater 18A. For example, a planar heater that is configured with resistance elements is applicable.

(2) In the first and second examples, it is explained that the first, second, and third temperature detection parts 16, 17, and 27 are thermistors that reduce resistance values in accordance with the increase in their temperatures. However, the temperature detection parts are not limited to thermistors. Posistor and thermocouples, etc. can be used.

(3) In the first and second examples, the structure of the belt system fuser 6 is explained using FIG. 4A. However, the structure of the fuser 6 is not limited to the belt system. The fuser control device of the present invention is applicable to a roller system fuser that fuses with the heat application roller 19 and the pressure application roller 20 as not using the fuser belt 19*a*. A fuser with a monochrome system (mono color system) in which the heat application roller 19 doesn't have an elastic layer is also applicable.

(4) In the first and second examples, from the rule of thumb that fusing deficiency doesn't occur when the temperature difference between the temperature Tcen of the central part of the fuser 6 and the end part temperature Tend of the sheet 1 is within 15° C., the coefficient α1 and the switch temperature Tcold1 are calculated. However, because heat resistances of elements vary due to the structure and materials of the fuser 6, and the structure and materials of the holding member 21 that holds the fuser 6, it is possible to experimentally obtain a condition in which fusing deficiency doesn't occur for each structure and material of the fuser 6 and the holding member 21, etc, and calculate the switch temperature Tcold1 from the obtained temperature difference condition and the coefficient α1.

(5) In the first and second examples, as an example of an image forming apparatus, a printer is explained. However, the image forming apparatus is not limited to a printer. For example, a multifunction peripheral, facsimile device, copier device, etc. are applicable.

What is claimed is:

1. A fuser control device, comprising:

a heat application part that generates heat and supplies the heat;

a fuser part that has a passage region where a print medium passes through and a not-passage region that is located at both sides of the passage region where the print medium does not pass through, and that fuses an image on the print medium by the heat applied from the heat application part while the print medium passes therethrough;

a first temperature detection part that detects a temperature of the passage region and outputs a first detection temperature determined by the detected temperature;

a second temperature detection part that detects another temperature of the not-passage region and outputs a second detection temperature determined by the detected another temperature;

a determination part that determines whether the fuser part is in a pre-fusion state or in a print execution state; and a heat application controller that preconfigures a first switch temperature for switching a target temperature of the fuser part for the pre-fusion state and a second switch temperature for switching the target temperature of the fuser part for the print execution state, and that changes the target temperature of the fuser part according to the first detection temperature, the second detection temperature and the first switch temperature if the determination part determines that the fuser part is in the pre-fusion state, that changes the target temperature of the fuser part according to the first detection temperature, the second detection temperature and the second switch temperature if the determination part determines that the fuser part is in the print execution state, and that controls the heat application part so that a temperature of the fuser part approaches the target temperature.

2. The fuser control device according to claim 1, further comprising:

a heat application member that applies the heat, which is generated by the heat application part, to the image; and a pressure application member that applies pressure on the print medium in a direction toward the heat application member.

3. The fuser control device according to claim 1, further comprising:

a heat application member that applies the heat, which is generated by the heat application part, to the image;

a pressure application member that applies pressure on the print medium in a direction toward the heat application member; and an endless belt that is arranged to contain the heat application member and contacts the pressure application member.

4. The fuser control device according to claim 1, further comprising:

a heat application member that applies the heat, which is generated by the heat application part, to the image;

a pressure application member that applies pressure on the print medium in a direction toward the heat application member; and an endless belt that is arranged to contain the pressure application member and contacts the heat application member.

5. The fuser control device according to claim 1, wherein the heat application part is a halogen heater.

6. The fuser control device according to claim 5, wherein the heat application part has a predetermined length in a direction perpendicular to a carrying direction of the print medium, and a heat generation quantity of an end part of the passage region in the fuser part is greater than another heat generation quantity of a central part of the passage region.

7. The fuser control device according to claim 1, wherein the heat application part is a planar heater.

8. The fuser control device according to claim 1, further comprising:

a holding member that holds the fuser part; and a third temperature detection part that detects a temperature of the holding member and outputs a third detection temperature determined by the detected temperature of the holding member, wherein the heat application controller changes the target temperature according to the first detection temperature and the second detection temperature and corrects the target temperature with the third detection temperature.

9. The fuser control device according to claim 8, wherein:

the lower the third detection temperature is, the higher the target temperature is corrected to be.

10. An image forming apparatus, wherein the fuser control device according to claim 1 is mounted.

11. The fuser control device according to claim 1, wherein the pre-fusion state is a heat application control state in which the fusion part is heated before fusing the image on the print medium, the print execution state is a heat application control state in which the fusion part is heated when fusing the image on the print medium, and the target temperature for the pre-fusion state and the target temperature for the print execution state are calculated by using different correction coefficients.

12. The fuser control device according to claim 11, wherein when the correction coefficient for the pre-fusion state is $\alpha_{warm\text{-}up}$, and the correction coefficient for the print execution state is $\alpha_{print}$, then a relationship $\alpha_{warm\text{-}up}>\alpha_{print}$ is satisfied.

13. The fuser control device according to claim 12, wherein when the first detection temperature is Tcen, the second detection temperature is Tside, and a print medium temperature is Tend, the target temperature for the pre-fusion state is determined by calculating the print medium temperature Tend from $Tend=\alpha_{warm\text{-}up}\times(Tside-Tcen)+Tcen$, and by comparing a temperature difference of the first detection temperature Tcen and the print medium temperature Tend, and the first switch temperature, and the target temperature for the print execution state is determined by calculating the print medium temperature Tend from $Tend=\alpha_{print}(Tside-Tcen)+Tcen$, and by comparing the temperature difference of the first detection temperature Tcen and the print medium temperature Tend, and the second switch temperature.

14. The fuser control device according to claim 1, wherein the target temperature is set high when a temperature difference between the second detection temperature and the first detection temperature is high.

15. A fuser control device, comprising:

a heat application part that generates heat and supplies the heat;

a fuser part that has a passage region where a print medium passes through and a not-passage region that is located at both sides of the passage region where the print medium does not pass through, and that perform a fusing to fuse an image on the print medium by the heat applied from the heat application part while the print medium passes therethrough;

a first temperature detection part that detects a temperature of the passage region and outputs a first detection temperature determined by the detected temperature;

a second temperature detection part that detects another temperature of the not-passage region and outputs a second detection temperature determined by the detected another temperature; and a heat application controller that changes a target temperature of the fuser part according to the first detection temperature and the second detection temperature, and controls the heat application part so that a temperature of the fuser part approaches the target temperature, wherein using a primary correlation coefficient of a first temperature difference between the first detection temperature and the second detection temperature and a second temperature difference between the first detection temperature and an end part temperature of the print medium that is configured for before performing the fusing and during the fusing, the heat application controller performs a temperature control of the fuser part by changing the target temperature of the fuser part before the fusing and during the fusing.

16. The fuser control device according to claim 15, wherein as the primary correlation coefficient, two types of correlation coefficients are obtained in advance, one for during the fusing, the other for before the fusing, the heat application controller determines if print is ready or not, when the surface temperature is high enough, the heat application controller determines printable and corrects the target temperature using the correlation coefficient for during the fusing, when the surface temperature is not high enough, the heat application controller determines not printable and corrects the target temperature using the correlation coefficient for before the fusing, the heat application controller determines if a temperature difference between the passage region and the not-passage region is greater than a predetermined value, when the temperature difference is not greater, the heat application controller perform a correction using the correlation coefficient, when the temperature difference is greater, the heat application controller does not perform the correction.

17. The fuser control device according to claim 15, further comprising:

a holding member that holds the fuser part; and a third temperature detection part that detects a temperature of the holding member and outputs a third detection temperature determined by the detected temperature of the holding member, wherein based on a relationship between the primary correlation coefficient with respect to the third detection temperature and a switch temperature that is the first temperature difference that is determined where a fusing deficiency does not occur, the heat application controller performs the temperature control of the fuser part as correcting the primary correlation coefficient and a lower limit temperature according to the third detection temperature.

18. An image forming apparatus, wherein the fuser control device according to claim 15 is mounted.

19. The fuser control device according to claim 15, wherein when the primary correlation coefficient before the fusing is $\alpha_{warm\text{-}up}$, and the primary correlation coefficient during the fusing is $\alpha_{print}$, then a relationship $\alpha_{warm\text{-}up}>\alpha_{print}$ is satisfied.

20. The fuser control device according to claim 19, wherein when the first detection temperature is Tcen, the second detection temperature is Tside, and the end part temperature of the print medium is Tend, the end part temperature Tend of the print medium before the fusing is determined from $Tend=\alpha_{warm\text{-}up}\times(Tside-Tcen)+Tcen$, and the end part temperature Tend of the print medium during the fusing is determined from $Tend=\alpha_{print}\times(Tside-Tcen)+Tcen$.

* * * * *